US008522949B2

(12) United States Patent
Nireki

(10) Patent No.: US 8,522,949 B2
(45) Date of Patent: Sep. 3, 2013

(54) PAPER SHEET PROCESSING APPARATUS

(75) Inventor: Takao Nireki, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 309 days.

(21) Appl. No.: 13/056,212

(22) PCT Filed: Jul. 28, 2009

(86) PCT No.: PCT/JP2009/063399

§ 371 (c)(1),
(2), (4) Date: Jan. 27, 2011

(87) PCT Pub. No.: WO2010/013697

PCT Pub. Date: Feb. 4, 2010

(65) Prior Publication Data

US 2011/0128122 A1 Jun. 2, 2011

(30) Foreign Application Priority Data

Jul. 28, 2008 (JP) ..... 2008-193648

(51) Int. Cl.
*G07D 7/06* (2006.01)
*G07D 7/20* (2006.01)

(52) U.S. Cl.
USPC ..... 194/207; 250/559.11

(58) Field of Classification Search
USPC ..... 194/207; 382/135, 137–140; 356/71; 250/550.04, 559.05, 559.07, 559.11, 556; 235/379; 209/534
See application file for complete search history.

(56) References Cited

U.S. PATENT DOCUMENTS 6,040,584 A * 3/2000 Liu et al. ..... 250/559.11
2006/0115138 A1* 6/2006 Klock et al. ..... 382/135

FOREIGN PATENT DOCUMENTS

| | | |
|---|---|---|
| JP | 1 169590 | 7/1989 |
| JP | 3 191495 | 8/1991 |
| JP | 6 60242 | 3/1994 |
| JP | 9 73573 | 3/1997 |
| JP | 2006 202075 | 8/2006 |
| JP | 2007 179323 | 7/2007 |

* cited by examiner

*Primary Examiner* — Mark Beauchaine
(74) *Attorney, Agent, or Firm* — Lexyoume IP Meister, PLLC.

(57) ABSTRACT

A paper sheet processing apparatus capable of preventing authentication accuracy from degrading even when a state change occurs due to attachment of water or the like. The paper sheet processing apparatus includes: a light receiving unit which receives transmitted and reflected lights from the paper sheet radiated by light emitting parts; a converter which converts the transmitted and reflected lights received by the light receiving part per pixel into data including color information having brightness; a RAM which stores transmitted and reflected light images received by the light receiving unit; an authenticity judgment processing part which determines the authenticity of the paper sheet based on the images stored in the RAM; and a determining part which excludes, based on a comparison result between brightness of the transmitted and reflected images in the predetermined area.

11 Claims, 13 Drawing Sheets

*Fig. 17*

226

Absorption

| y \ x | 1 | 2 | 3 | 4 | 5 | 6 | 7 |
|---|---|---|---|---|---|---|---|
| 1 | 0.239 | 0.126 | 0.590 | 0.288 | 0.516 | 0.362 | 0.170 |
| 2 | 0.296 | 0.568 | 0.695 | 0.285 | 0.291 | 0.291 | 0.387 |
| 3 | 0.283 | 0.113 | 0.508 | 0.316 | 0.167 | 0.340 | 0.565 |
| 4 | 0.384 | 0.022 | 0.069 | 0.343 | 0.329 | 0.469 | 0.425 |
| 5 | 0.049 | 0.143 | 0.598 | 0.277 | 0.335 | 0.609 | 0.124 |
| 6 | 0.557 | 0.041 | 0.579 | 0.398 | 0.258 | 0.225 | 0.393 |
| 7 | 0.458 | 0.527 | 0.384 | 0.425 | 0.626 | 0.519 | 0.129 |
| 8 | 0.587 | 0.618 | 0.423 | 0.365 | 0.137 | 0.549 | 0.382 |
| 9 | 0.590 | 0.684 | 0.420 | 0.343 | 0.346 | 0.154 | 0.242 |
| 10 | 0.285 | 0.373 | 0.214 | 0.302 | 0.192 | 0.670 | 0.623 |
| 11 | 0.530 | 0.233 | 0.118 | 0.373 | 0.555 | 0.033 | 0.137 |
| 12 | 0.475 | 0.552 | 0.351 | 0.291 | 0.299 | 0.497 | 0.415 |

226

Reflection

| y \ x | 1 | 2 | 3 | 4 | 5 | 6 | 7 |
|---|---|---|---|---|---|---|---|
| 1 | 0.5075 | 0.5825 | 0.2732 | 0.4745 | 0.3226 | 0.4251 | 0.5532 |
| 2 | 0.469 | 0.2878 | 0.2037 | 0.4763 | 0.4727 | 0.4727 | 0.4086 |
| 3 | 0.4782 | 0.5916 | 0.3281 | 0.4562 | 0.555 | 0.4397 | 0.2897 |
| 4 | 0.4105 | 0.3912 | 0.3725 | 0.4379 | 0.4471 | 0.3537 | 0.383 |
| 5 | 0.6337 | 0.3429 | 0.1606 | 0.4818 | 0.4434 | 0.2604 | 0.5843 |
| 6 | 0.2952 | 0.3835 | 0.1683 | 0.4013 | 0.4946 | 0.5166 | 0.405 |
| 7 | 0.361 | 0.1892 | 0.2463 | 0.383 | 0.2494 | 0.3208 | 0.5807 |
| 8 | 0.275 | 0.1529 | 0.2309 | 0.4233 | 0.5752 | 0.3007 | 0.4123 |
| 9 | 0.2732 | 0.211 | 0.3867 | 0.4379 | 0.4361 | 0.5642 | 0.5056 |
| 10 | 0.4763 | 0.4178 | 0.5239 | 0.4654 | 0.5386 | 0.2201 | 0.2512 |
| 11 | 0.3135 | 0.5111 | 0.588 | 0.4178 | 0.297 | 0.6447 | 0.5752 |
| 12 | 0.3501 | 0.2988 | 0.4324 | 0.4727 | 0.4672 | 0.3354 | 0.3903 |

226

Transmission

| y \ x | 1 | 2 | 3 | 4 | 5 | 6 | 7 |
|---|---|---|---|---|---|---|---|
| 1 | 0.2537 | 0.2912 | 0.1366 | 0.2373 | 0.1613 | 0.2125 | 0.2766 |
| 2 | 0.2345 | 0.1439 | 0.1018 | 0.2382 | 0.2363 | 0.2363 | 0.2043 |
| 3 | 0.2391 | 0.2958 | 0.1641 | 0.2281 | 0.2775 | 0.2199 | 0.1448 |
| 4 | 0.2052 | 0.5868 | 0.5588 | 0.219 | 0.2235 | 0.1769 | 0.1915 |
| 5 | 0.3169 | 0.5144 | 0.2409 | 0.2409 | 0.2217 | 0.1302 | 0.2922 |
| 6 | 0.1476 | 0.5753 | 0.2525 | 0.2007 | 0.2473 | 0.2583 | 0.2025 |
| 7 | 0.1805 | 0.2838 | 0.3694 | 0.1915 | 0.1247 | 0.1604 | 0.2903 |
| 8 | 0.1375 | 0.2294 | 0.3464 | 0.2116 | 0.2876 | 0.1503 | 0.2061 |
| 9 | 0.1366 | 0.1055 | 0.1933 | 0.219 | 0.218 | 0.2821 | 0.2528 |
| 10 | 0.2382 | 0.2089 | 0.262 | 0.2327 | 0.2693 | 0.1101 | 0.1256 |
| 11 | 0.1567 | 0.2556 | 0.294 | 0.2089 | 0.1485 | 0.3224 | 0.2876 |
| 12 | 0.175 | 0.1494 | 0.2162 | 0.2363 | 0.2336 | 0.1677 | 0.1952 |

226

Reflection − Transmission

| y \ x | 1 | 2 | 3 | 4 | 5 | 6 | 7 |
|---|---|---|---|---|---|---|---|
| 1 | 0.254 | 0.291 | 0.137 | 0.237 | 0.161 | 0.213 | 0.277 |
| 2 | 0.235 | 0.144 | 0.102 | 0.238 | 0.236 | 0.236 | 0.204 |
| 3 | 0.239 | 0.296 | 0.164 | 0.228 | 0.278 | 0.220 | 0.145 |
| 4 | 0.205 | −0.196 | −0.186 | 0.219 | 0.224 | 0.177 | 0.192 |
| 5 | 0.317 | −0.171 | −0.080 | 0.241 | 0.222 | 0.130 | 0.292 |
| 6 | 0.148 | −0.192 | −0.084 | 0.201 | 0.247 | 0.258 | 0.202 |
| 7 | 0.181 | −0.095 | −0.123 | 0.192 | 0.125 | 0.160 | 0.290 |
| 8 | 0.138 | −0.076 | −0.115 | 0.212 | 0.288 | 0.150 | 0.206 |
| 9 | 0.137 | 0.105 | 0.193 | 0.219 | 0.218 | 0.282 | 0.253 |
| 10 | 0.238 | 0.209 | 0.262 | 0.233 | 0.269 | 0.110 | 0.126 |
| 11 | 0.157 | 0.256 | 0.294 | 0.209 | 0.148 | 0.322 | 0.288 |
| 12 | 0.175 | 0.149 | 0.216 | 0.236 | 0.234 | 0.168 | 0.195 |

PAPER SHEET PROCESSING APPARATUS

FIELD OF THE INVENTION

The present invention relates to a paper sheet processing apparatus which judges an authenticity of a bill, a gift certificate, a coupon ticket, and so on (hereafter, these are collectively referred to as a paper sheet).

BACKGROUND ART

In general, a bill processing apparatus, which handles a bill as one of the embodiments of the paper sheet, is incorporated into a service device such as a game medium rental machine installed in a game hall, a vending machine or a ticket-vending machine installed in a public space, or the like which judges the authenticity of the bill inserted from a bill insertion slot by a user and provides various types of products and services in accordance with a value of the bill having been judged as authentic.

Generally, in a bill authenticity judgment process, for example as disclosed in Patent Reference 1, a bill moving along the bill travelling route is irradiated with light, and the transmitted light and reflected light from the bill are detected by a light receiving sensor and compared with reference data stored in dictionary data. More specifically, the transmitted light data and reflected light data from the conveyed bill are acquired, converted for example to brightness information, and compared with normal data.

[Patent Reference 1] Japanese unexamined patent application publication No. H6-60242

DISCLOSURE OF THE INVENTION

Problem to be Solved by the Invention

The above transmitted light data and reflected light data may have a difference in brightness depending on the bill's condition. This may occur, for example, when the fibrous bill surface is wet, in other words when the fibrous, rough surface the bills generally have is optically smoothed. In such a case, diffuse reflection is presumably reduced on the smoothed part. In other words, when a bill is wet and its surface is smoothed, diffuse reflection on the bill surface is reduced and more light is transmitted through the bill; the transmitted light data present increased brightness (light intensity). On the other hand, the reflected light data present decreased brightness (light intensity) because diffuse reflection on the bill surface is reduced and more light is transmitted through the bill.

Consequently, when a wet bill is subject to a bill authenticity judgment process, the bill may not match the dictionary data because of a difference in brightness resulting from a changed amount of light obtained by the light receiving sensor even if the bill is a legitimate bill. In such a case, the bill may be identified to be a forged bill.

The present invention provides a paper sheet processing apparatus capable of preventing reduction in the accuracy of authenticity judgment even if paper sheets have some state change, such as being wet.

Means to Solve the Problem

In order to achieve the above purpose, the paper sheet processing apparatus comprises: a light emitting part which irradiates a paper sheet with light; a light receiving part which receives transmitted light through the paper sheet and reflected light from the paper sheet, the paper sheet being irradiated by the light emitting part; a converter which converts the transmitted light and reflected light received by the light receiving part into data including color information having brightness per pixel of a predetermined size as a unit; a storage part which stores a transmitted light image constituted of a plurality of pixels converted by the converter from the transmitted light received by the light receiving part and a reflected light image constituted of a plurality of pixels converted by the converter from the reflected light received by the light receiving part; an authenticity judgment processing part which judges an authenticity of the paper sheet based on each image stored by the storage part; and a determining part which excludes a predetermined area from an object for an authenticity judgment based on a comparison result between brightness of pixels in the predetermined area of the transmitted image and brightness of pixels of the reflected image corresponding to the predetermined area of the transmitted image.

Further features of the present invention, its nature, and various advantages will be more apparent from the accompanying drawings and the following description of the preferred embodiment.

BRIEF DESCRIPTION OF THE DRAWINGS

FIG. 6 is a block diagram showing a configuration of control means which controls driving of driving members such as a bill conveyance mechanism, bill reading means, and the like.

FIG. 17 illustrates examples of brightness data of pixels in an area including a predetermined area of a bill.

DESCRIPTION OF NOTATIONS

Figure 1:
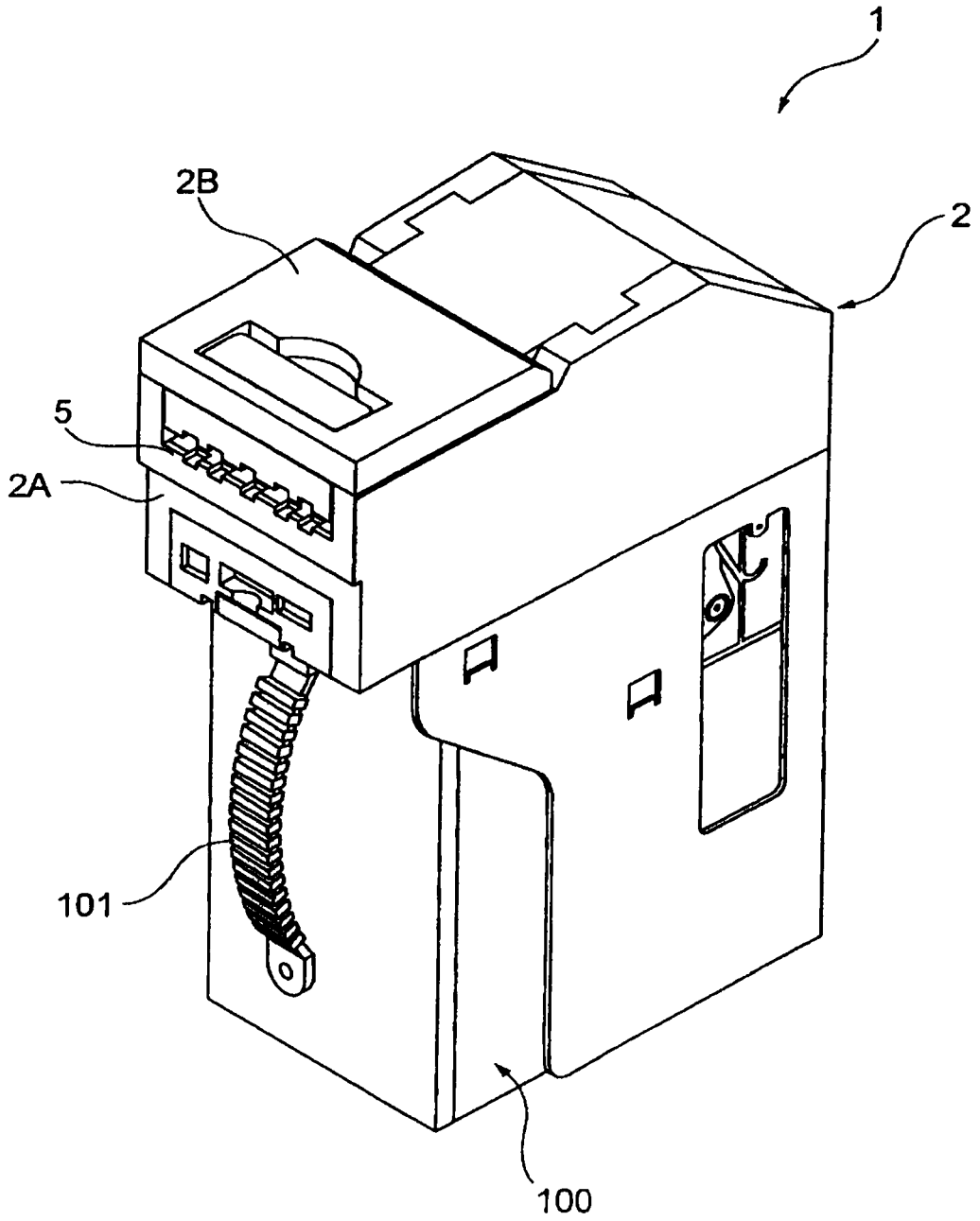
FIG. 1 is a perspective view showing an entire structure to illustrate a configuration of a bill processing apparatus of this embodiment.

1 bill processing apparatus
2 apparatus main body
3 bill traveling route
5 bill insertion slot
6 bill conveyance mechanism
8 bill reading means
10 skew correction mechanism
80*a* first light emitting part
81 light receiving/emitting unit
81*a* light receiving part
81*b* second light emitting part
200 control means

BEST MODE FOR CARRYING OUT THE INVENTION

Hereinafter, an embodiment of the present invention will be described with reference to the drawings.

Figure 2:
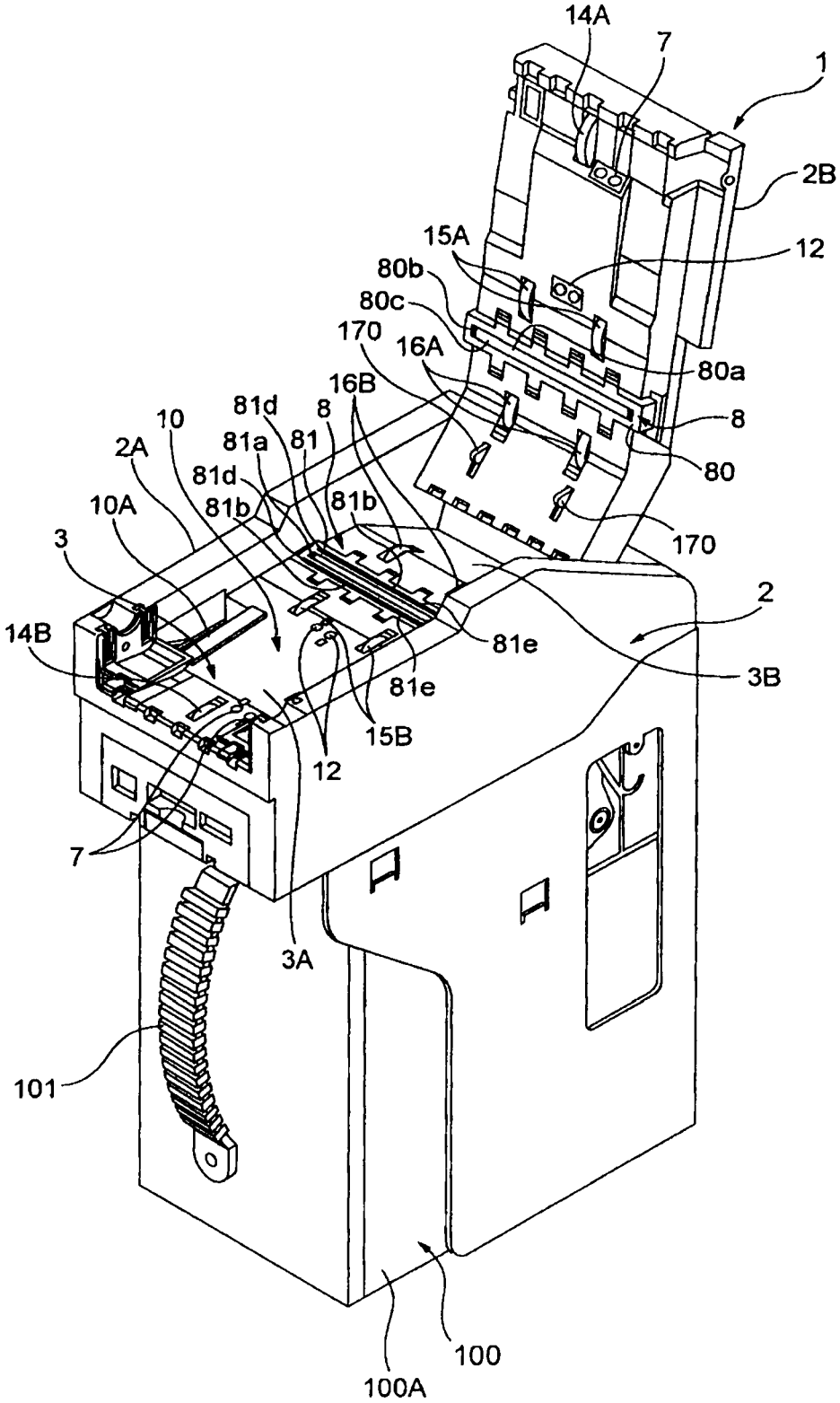
FIG. 2 is a perspective view showing the bill processing apparatus in a state that an open/close member is opened for a main body frame of an apparatus main body.
Figure 3:
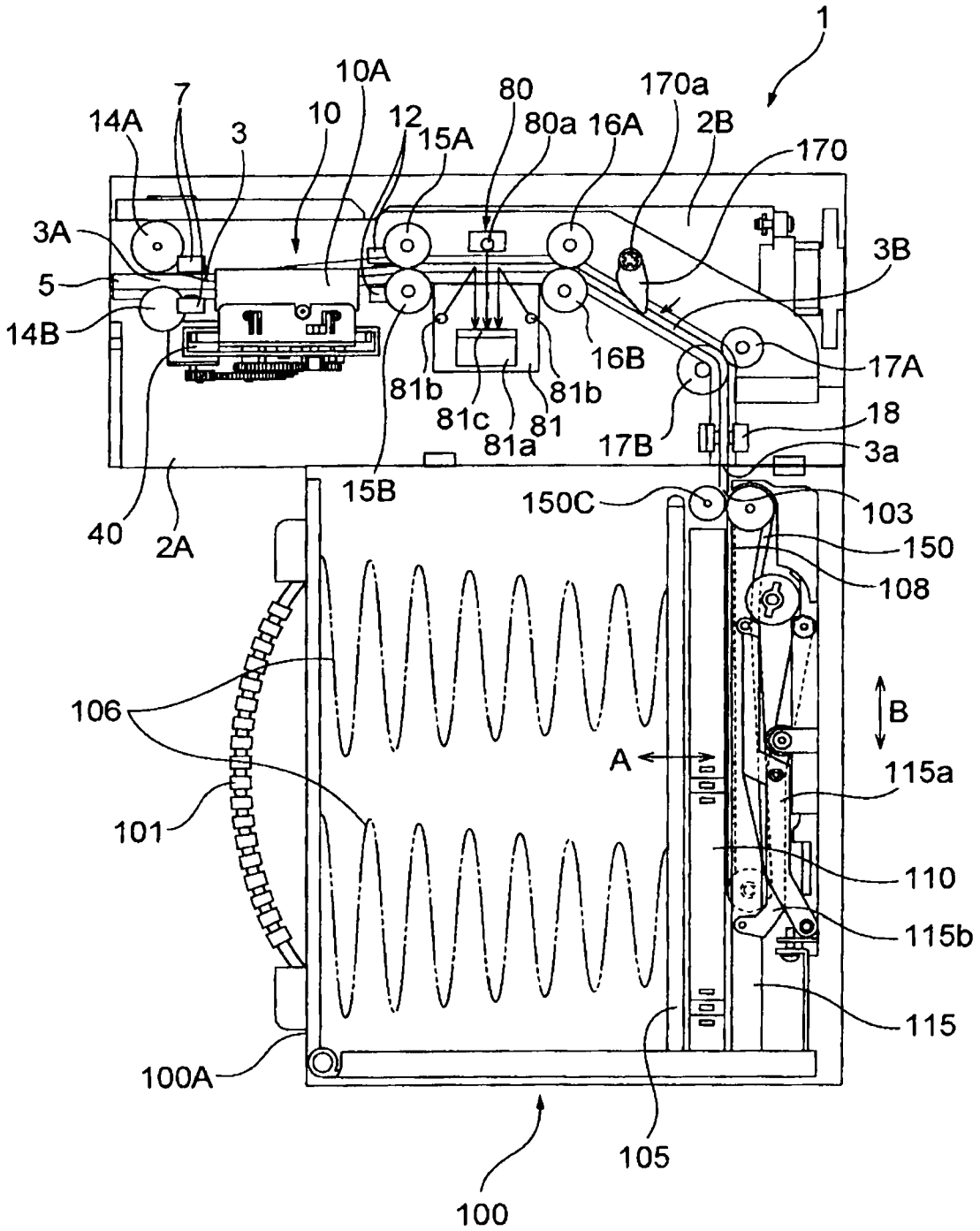
FIG. 3 is a right side view schematically showing a traveling route of a bill to be inserted from an insertion slot.
Figure 4:
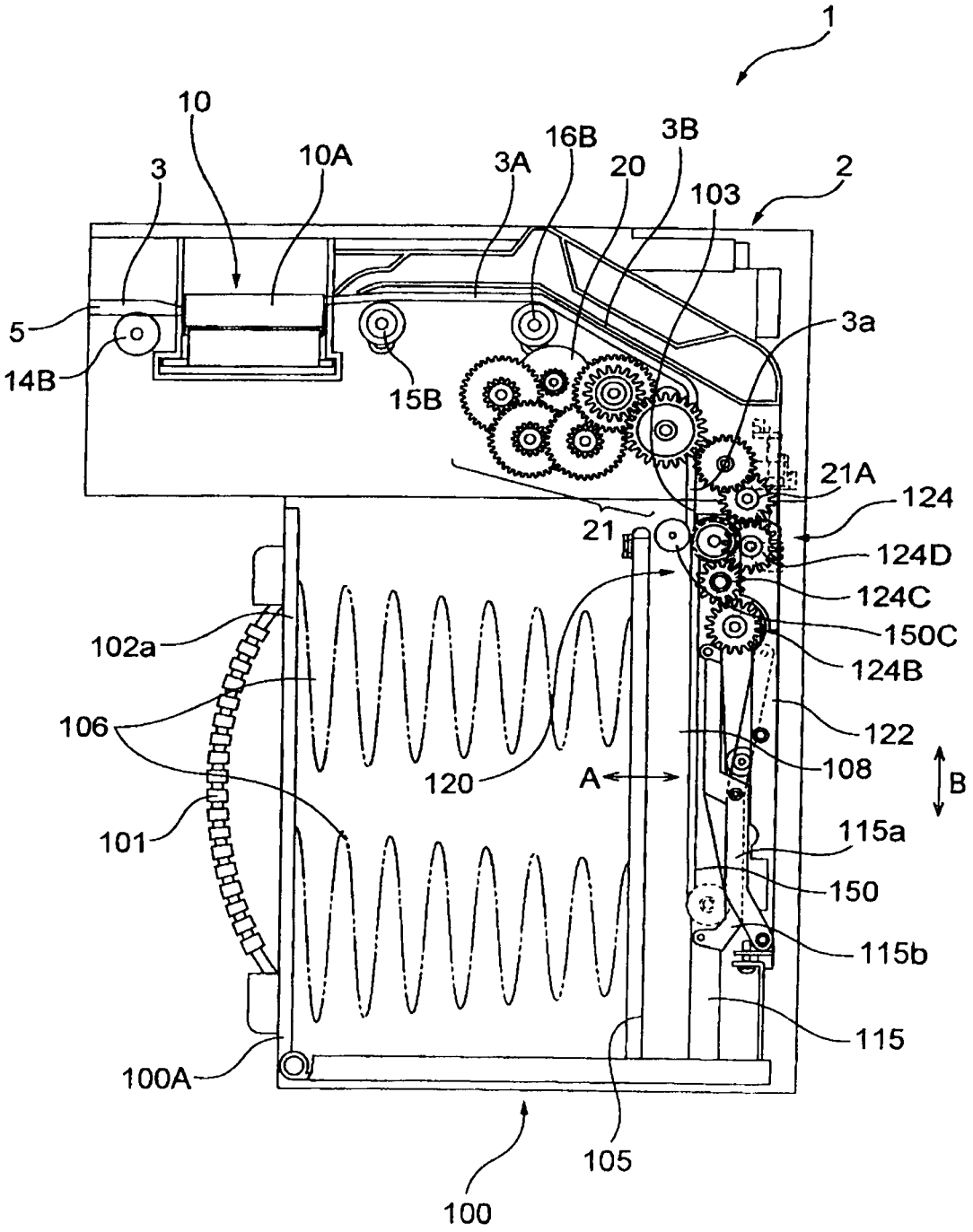
FIG. 4 is a right side view showing a schematic configuration of a power transmission mechanism for driving the presser plate arranged in a bill housing part.
Figure 5:
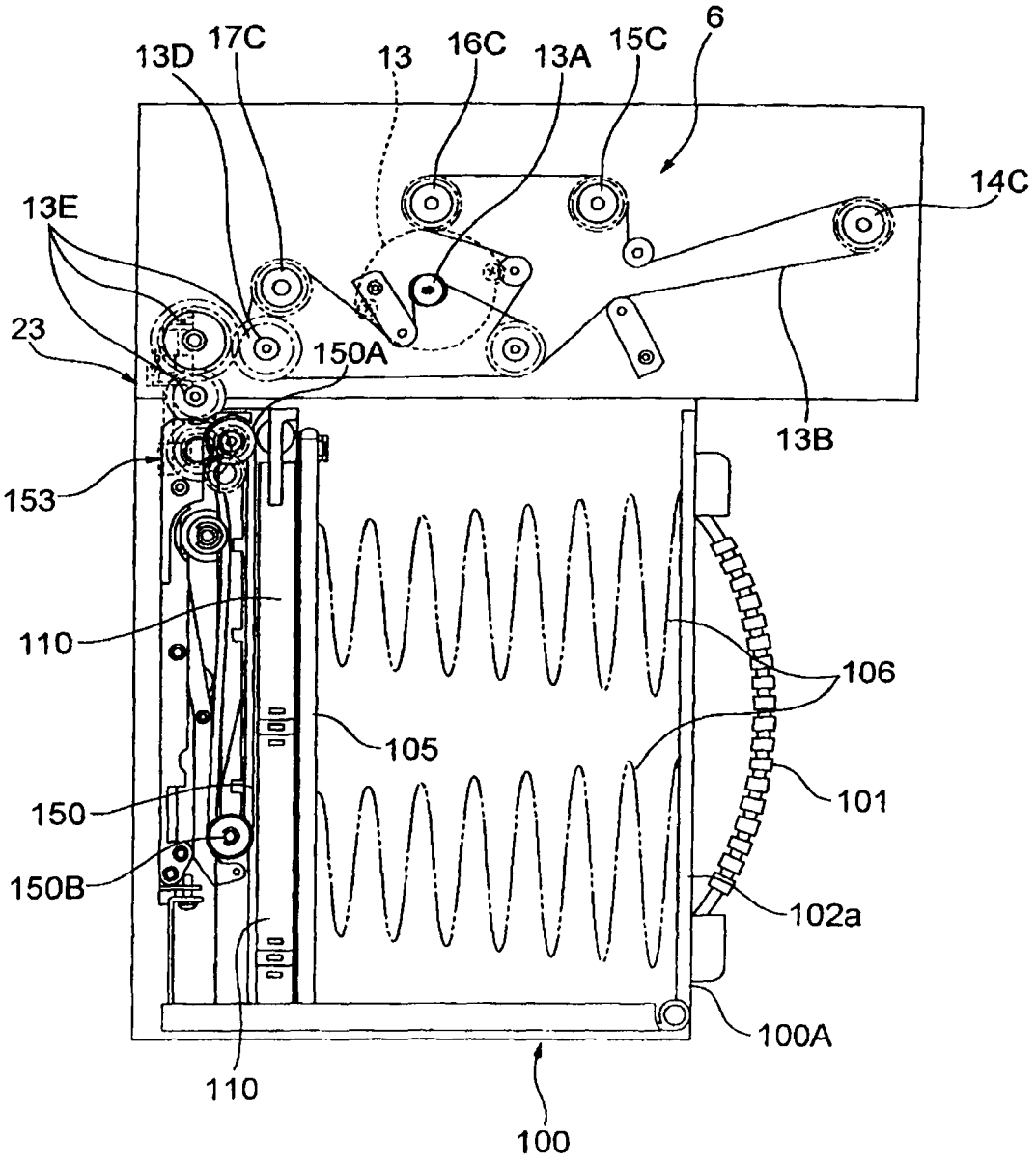
FIG. 5 is a left side view showing a schematic configuration of a driving source and a driving force transmission mechanism to drive a bill conveyance mechanism.

FIGS. 1 to 5 are diagrams showing a configuration of a bill processing apparatus according to this embodiment. FIG. 1 is a perspective view showing a general configuration thereof; FIG. 2 is a perspective view showing a state that an open/close member is opened for a main body frame of an apparatus main body; FIG. 3 is a right side view showing schematically a traveling route for a bill inserted from an insertion slot; FIG. 4 is a right side view showing schematically a power transmission mechanism for driving a presser plate installed in a bill housing part; and FIG. 5 is a left side view showing a schematic configuration of a driving source and a driving force transmission mechanism to drive a bill conveyance mechanism.

A bill processing apparatus 1 of this embodiment is so configured that it can be incorporated into, for example, various types of gaming machines such as a slot machine and the like, and the bill processing apparatus 1 includes an apparatus main body 2 and a housing part (e.g., stacker or cashbox) 100 which is provided to the apparatus main body 2 and is capable of stacking and housing a great number of bills. Here, the housing part 100 may be mountable to and demountable from the apparatus main body 2, and it is possible, for example, to remove it from the apparatus main body 2 by pulling a handle 101 provided on the front face thereof in a state that a lock mechanism (not shown) is unlocked.

As shown in FIG. 2, the apparatus main body 2 has a main frame body 2A and an open/close member 2B being configured to be opened and closed for the main body frame 2A by rotating around an axis positioned at one end thereof as a rotating center. Then, as shown in FIG. 3, the frame 2A and the open/close member 2B are configured to form a space (bill traveling route 3) through which a bill is conveyed such that both face each other across the space when the open/close member 2B is closed for the main body frame 2A, and to form a bill insertion slot 5 such that front exposed faces of both are aligned and that the bill traveling route 3 exits at the bill insertion slot 5. In addition, the bill insertion slot 5 is a slit-like opening from which a short side of a bill can be inserted into the inside of the apparatus main body 2.

Also, in the apparatus main body 2, a bill conveyance mechanism 6 that conveys a bill along a bill traveling route 3; an insertion detecting sensor 7 that detects the bill inserted into the bill insertion slot 5; bill reading means 8 that is installed on a downstream side of the insertion detecting sensor 7 and reads out information on the bill in a traveling sate; a skew correction mechanism 10 that accurately positions and conveys the bill with respect to the bill reading means 8; a movable piece passage detecting sensor 12 that detects that the bill passes through a pair of movable pieces constituting the skew correction mechanism; and a discharge detecting sensor 18 that detects that the bill is discharged into a bill housing part 100 are provided.

Hereafter, the respective components described above will be described in detail. The bill traveling route 3 extends from the bill insertion slot 5 toward the inside, and comprises a first traveling route 3A and a second traveling route 3B extending from the first traveling route 3A toward the downstream side and being inclined downwardly at a predetermined angle to the first traveling route 3A. The second traveling route 3B is bent in a vertical direction on the downstream side and a discharge slot 3*a* from which the bill is discharged into the bill housing part 100 is formed at an end portion on the downstream side such that the bill discharged from the discharge slot 3*a* is fed into a feed port (receiving port) 103 of the bill housing part 100 in the vertical direction.

The bill conveyance mechanism 6 is a mechanism capable of conveying the bill inserted from the bill insertion slot 5 along the insertion direction, and of conveying back the bill in an insertion state toward the bill insertion slot 5. The bill conveyance mechanism 6 comprises a motor 13 (refer to FIG. 5) serving as a driving source installed in the apparatus main body 2; and conveyor roller pairs (14A and 14B), (15A and 15B), (16A and 16B), and (17A and 17B) which are installed with predetermined intervals along the bill traveling direction in the bill traveling route 3, and are driven to rotate by the motor 13.

The conveyor roller pairs are installed so as to be partially exposed on the bill traveling route 3, and all the pairs are constituted of driving rollers of the conveyor rollers 14B, 15B, 16B, and 17B installed on the underside of the bill traveling route 3 driven by the motor 13; and pinch-rollers of the conveyor rollers 14A, 15A, 16A, and 17A installed on the upperside and driven by the these driving rollers. In addition, the conveyor roller pair (14A and 14B) to first nip and hold therebetween the bill inserted from the bill insertion slot 5, and to convey the bill toward the back side, as shown in FIG. 2, is installed in one portion of the center position of the bill traveling route 3, and a couple of the conveyor roller pairs (15A and 15B), (16A and 16B), or (17A and 17B) being disposed in this order on the downstream side thereof are respectively installed in a couple of portions with a predetermined interval in the lateral direction of the bill traveling route 3.

Further, the conveyor roller pair (14A and 14B) disposed in the vicinity of the bill insertion slot 5 is usually in a state that the upper conveyor roller 14A is spaced from the lower conveyor roller 14B, and the upper conveyor roller 14A is driven to move toward the lower conveyor roller 14B to nip and hold the inserted bill therebetween when insertion of the bill is detected by the insertion detecting sensor 7.

Thus, the upper conveyor roller 14A is controllably driven to be pressed against or spaced from the lower conveyor roller 14B by a motor 70 (refer to FIG. 6) for an up-and-down movement of the roller as a driving source. In this case, when a process (skew correction process) for positioning the bill with respect to the bill reading means 8 by eliminating inclination of the inserted bill is executed by the skew correction mechanism 10, the upper conveyor roller 14A is spaced from the lower conveyor roller 14B so as to release the load on the bill, and when the skew correction process is completed, the upper conveyor roller 14A is driven to move toward the lower conveyor roller 14B again to hold (or nip) the bill therebetween. Here, the driving source may be constituted of a solenoid or the like instead of a motor.

Further, the skew correction mechanism 10 comprises a pair of right and left movable pieces 10A (only one side is shown) such that the pair of right and left movable pieces 10A are moved to get closer with each other by driving a motor 40 for a skew driving mechanism, whereby the skew correction process is performed for the bill.

The conveyor rollers 14B, 15B, 16B and 17B installed on the underside of the bill traveling route 3 are, as shown in FIG. 5, driven to rotate via the motor 13 and pulleys 14C, 15C, 16C, and 17C installed at the ends of the driving shafts of the respective conveyor rollers. That is, a driving pulley 13A is installed on the output shaft of the motor 13, and a driving belt 13B is wrapped around between the pulleys 14C, 15C, 16C, and 17C installed at the ends of the driving shafts of the respective conveyor rollers and the driving pulley 13A. In addition, tension pulleys are engaged in places with the driving belt 13B, which prevents the driving belt 13B from loosening.

In accordance with the configuration described above, when the motor 13 is driven to normally rotate, the conveyor rollers 14B, 15B, 16B, and 17B are driven to normally rotate in synchronization therewith to convey the bill toward the insertion direction. When the motor 13 is driven to reversely rotate, the conveyor rollers 14B, 15B, 16B, and 17B are driven to reversely rotate in synchronization therewith to convey back the bill toward the bill insertion slot 5 side.

The insertion detecting sensor 7 is to generate a detection signal when a bill inserted into the bill insertion slot 5 is detected. And when the detection signal is generated, the motor 13 is driven in a normal direction and the bill is conveyed in the insertion direction. The insertion detecting sensor 7 of this embodiment is installed between the pair of conveyor rollers (14A and 14B) and the skew correction mechanism 10 and comprises, for example, an optical sensor such as a regressive reflection type photo sensor. However, the insertion detecting sensor 7 may comprise a mechanical sensor other than the optical sensor.

Further, the movable piece passage detecting sensor 12 is to generate a detection signal when it is detected that a front end of the bill passes through a pair of right and left movable pieces 10A constituting the skew correction mechanism 10, and when the detection signal is generated, the driving by the motor 13 is stopped such that the skew correction is made. The movable piece passage detecting sensor 12 of this embodiment is disposed on the upstream side from the bill reading means 8 and also comprises an optical sensor or a mechanical sensor in the same way as mentioned before with respect to the insertion detecting sensor.

Further, the discharge detecting sensor 18 is to detect a trailing end of the bill passing through such that it is detected that the bill is discharged into the bill housing part 100. The discharge detecting sensor 18 is disposed just in front of the receiving port 103 of the bill housing part 100 on the downstream side of the second traveling route 3B. When the detection signal is transmitted from the discharge detecting sensor 18, the driving by the motor 13 is stopped and the conveyance processing of the bill is terminated. The discharge detecting sensor 18 also comprises an optical sensor or a mechanical sensor in the same way as the aforementioned insertion detecting sensor.

The bill reading means 8 reads bill information on the bill conveyed in a state that the skew is eliminated by the skew correction mechanism 10, and determines the validity (authenticity). In this embodiment, the bill reading means 8, which is installed in the above-mentioned first traveling route 3A, comprises a line sensor which irradiates the bill being conveyed from top and bottom sides thereof with light such that a transmitted light and a reflected light thereof are detected by a light receiving part so as to perform reading.

Here, the configuration of above-mentioned reading means 8 will be described in detail with reference to FIGS. 2 and 3.

The abovementioned bill reading means 8 has a light emitting unit 80 which is installed on the side of the open/close member 2B and provided with a first light emitting part 80*a* capable of irradiating the upper side of the bill to be conveyed with the infrared light and the red light, and a light receiving/emitting unit 81 which is installed on the side of the main body frame 2A.

The light receiving/emitting unit 81 has a light receiving part 81*a* which is provided with a light receiving sensor facing the first light emitting part 80*a* across the bill (bill traveling route) and second light receiving parts 81*b* which are installed adjacently on the both sides of the light receiving part 81*a* along the bill traveling direction and are capable of irradiating the object with the infrared light and the red light.

The first light emitting part 80*a* disposed to face the light receiving part 81*a* works as a light source for the transmissive light. This first light emitting part 80*a* is, as shown in FIG. 2, comprised of a rectangular bar-like body made of synthetic resin which emits the light guided through a light guiding body 80*c* provided inside from an LED element 80*b* fixed to one end of the bar-like body. The first light emitting part having such a configuration is linearly installed in parallel with the light receiving part 81*a* (light receiving sensor) so as to be capable of entirely and equally irradiating the entire (or whole) range in the width direction of the traveling route of the bill to be conveyed although the configuration is simple.

The light receiving part 81*a* of the light receiving/emitting unit 81 is formed in a thin-walled plate shape having a band shape extending in a lateral direction of the bill traveling route 3 and having a width to an extent that the sensitivity of the light receiving sensor (not shown) provided in the light receiving part 81*a* is not affected. In addition, the light receiving sensor is configured as a so-called line sensor in which a plurality of CCDs (Charge Coupled Devices) are provided linearly at the center in the thickness direction of the light receiving part 81*a*, and a GRIN lens array 81*c* is disposed linearly above these CCDs so as to collect the transmitted light and the reflected light.

The second light emitting part 81*b* of the light receiving/emitting unit 81 works as a light source for the reflection light. This second light emitting part 81*b* is, in a similar manner as the first emitting part 80*a*, comprised of a rectangular bar-like body made of synthetic resin which emits the light guided through a light guiding body 81*e* provided inside from an LED element 81*d* fixed to one end of the bar-like body. The second light emitting part 81*b* is also configured to be linearly installed in parallel with the light receiving part 81*a* (line sensor).

The second light emitting parts 81*b* are capable of irradiating the bill with the light at an elevation angle of 45 degrees, for example, and are so installed that the light receiving part 81*a* may receive the reflected light from the bill. In this case, the lights irradiated to the bill by the second light emitting parts 81*b* are to be made incident at 45 degrees onto the light receiving part 81*a*, but the incident angle is not limited to 45 degrees such that the arrangement may be re-arranged as appropriate as long as the lights are irradiated evenly to the surface of the bill. Therefore, the arrangement of the second light emitting parts 81*b* and the light receiving part 81*a* may be appropriately changed in design in accordance with the structure of the bill processing apparatus.

Further, the second light emitting parts 81*b* are disposed on the both sides of the light receiving part 81*a* so as to be disposed across the light receiving part 81*a* and irradiate the bill with the respective lights at respective incident angles of 45 degrees. This is because, in the case where the surface of the bill has scratches or folded wrinkles, and in the case where the light is irradiated only from one side to an uneven surface generated by these scratches or folded wrinkles, it is unavoidable to make some portions shaded to cause shadow in the uneven surface. Therefore, it is prevented that the shadow is made in the portion of the uneven surface by irradiating the bill with the lights from the both sides, whereby the image data to be acquired can have a higher degree of accuracy than that of the single side irradiation. As a matter of course, the apparatus may comprise only one second light emitting part 81*b* installed on either side, and the configuration, the arrangement, and the like of the light emitting unit 80 and the light receiving/emitting unit 81 as described above are not limited to those described in this embodiment, and may be modified as appropriate.

An authenticity judgment process is conducted by comparing image data obtained by reflected light (irradiated light by the second light emitting part 81*b*) and transmitted light (irradiated light by the first light emitting part 80*a*) from the bill which are acquired by the above-mentioned light receiving part 81*a* with the image data of the legitimate bill. In this case, since the legitimate bill has some area from which different image data are acquired depending on the wavelengths of the lights (for example, visible light or infrared light) irradiated to the area, in the authenticity judgment process in this embodiment, a plurality of light sources, in consideration of this view point, irradiate different lights of different wavelengths (in this embodiment, a red light and an infrared light are irradiated) to the bill and a transmitted light therethrough and a reflected light thereon are detected such that the authenticity identification accuracy may be improved. That is, since the red light and the infrared light have different wavelengths, transmitted-light data and reflected-light data from a plurality of lights of different wavelengths may be utilized for the bill authenticity judgment whereby the judgment may use the nature that the transmittance of the transmitted light transmitted through the specific area and the reflectance of the reflected light reflected on the specific area in the legitimate bill are different from those of the counterfeit bill. Therefore, in the above-mentioned light emitting part (first light emitting part 80*a* and second light emitting part 81*b*), an attempt is made to further improve the bill authenticity identification accuracy by employing light sources where a plurality of wavelengths are available.

Here, since it is possible to acquire various kinds of received-light data (transmitted-light data and reflected-light data) depending on the wavelengths of the irradiated lights to the bill and the irradiated areas of the bill, although a concrete bill authenticity identification method will not be written in detail, the image appears greatly different depending on the lights in a watermark area of the bill, for example, if an image on the area is viewed with the lights of different wavelengths. Therefore, it can be considered that the bill to become an identification object is identified as the legitimate bill or the counterfeit bill by setting this portion as the specified area, acquiring transmitted-light data and reflected-light data from the specified area, and comparing such data with legitimate data from the same specified area of the legitimate bill having been stored in advance in storage means such as ROM. At this time, provided that specified areas are predetermined according to the kinds of the bills, and that predetermined weighting may be applied to the transmitted-light data and the reflected-light data from this specified area, the authenticity identification accuracy may be improved.

In addition, the above-mentioned light emitting part (first light emitting part 80*a* and second light emitting part 81*b*) is controlled to light with a predetermined interval and transmitted light and reflected light are detected by the light receiving part (line sensor) 81*a* when the bill passes. The light receiving part (line sensor) 81*a* can acquire contrasting density data (a plurality of pixel data per a predetermined size as a unit which include brightness) in accordance with the brightness and it is also possible to generate two-dimensional image from such pixel data.

That is, the pixel data acquired by the line sensor is converted into data including color information having brightness for each pixel by a converter which will be described later. Here, the color information of each pixel having brightness to be converted by the converter is what is represented by a numerical value from 0 to 255 (e.g., 0: black to 255: white) assigned to each pixel according to the brightness.

Therefore, in the authenticity judgment process as described above, the predetermined area of the bill may be extracted; the color information per each pixel having brightness included in the area and color information per each pixel having brightness of the same area of a legitimate bill may be used; then a coefficient of correlation is calculated by an appropriate correlation formula as such information is plugged therein; and it is possible to identify the authenticity of the bill by the coefficient of correlation. Or, in addition to the above description, analog waveforms, for example, may be generated from the transmitted-light data and the reflected-light data, and the respective shapes of those waveforms may be compared with each other, whereby the authenticity identification may be conducted by such comparison. Moreover, a process in which the length of a printing area of the bill is detected and the authenticity thereof is identified by utilizing the length information, may also be provided.

Before executing the above authenticity judgment process, a predetermined area is set up in a bill to be inserted. With regard to the predetermined area, comparison is made between a transmitted image consisting of multiple pixels converted by a converter from the transmitted light received by the light receiving part 81*a* and a reflected image consisting of multiple pixels converted by the converter from the reflected light received by the light receiving part 81*a* and, based on the comparison results, a process of excluding the predetermined area from the authenticity judgment (the authenticity judgment exclusion process) is executed.

The authenticity judgment exclusion process will be described hereafter.

As described above, in the bill authenticity judgment process, a conveyed bill is irradiated with light from the light emitting part and the transmitted light and reflected light are received by the light receiving part, photoelectrically-converted, and converted by the converter to image date (transmitted image data and reflected image data) containing color information including brightness on the basis of pixels. The information of each pixel converted by the converter corresponds to brightness (luminance value) and a value ranging from 0 to 255 (for example, 0 for black and 255 for white) is assigned to each pixel according to the brightness. This is compared with the pixel data regarding legitimate bills and stored in advance.

Therefore, when a bill inserted by the user has some state change (mainly being wet or pierced), the transmitted image data present higher brightness than the reflected image data in the part having the state change (pixels have higher brightness). In this regard, the transmitted image data do not present higher brightness than the reflected image data if a bill does not have such state change. Therefore, a bill having such state change is identified as a forged bill as a result of comparison with pixel data regarding legitimate bills in the conventional authenticity judgment process.

In other words, when a bill has some state change such as being wet or pierced, even a legitimate bill may be identified as a forged bill as a result of comparison on the conditionally changed part, which may cause some inconvenience to the user.

Therefore, in the present invention, a predetermined area is set up on the bill to be inserted in advance and, even if the bill has the above-described state change on that part, the bill is not immediately assumed to be a forged bill and other parts are used for comparison in the authenticity judgment process. In other words, the pixel data of a predetermined area are acquired and, if the transmitted image data present higher brightness than the reflected image data in the predetermined area, it is assumed that the bill simply has some state change; then, the authenticity judgment process is conducted for other areas.

In this regard, it is assumed that the bill simply has some state change as a result of comparison between the transmitted image data and reflected image data of a predetermined area, for example, when the following mathematical equation (Equation 1) is satisfied provided that numerical values 0 to 255 (0 for black and 255 for white) are assigned according to the brightness of the pixels of the transmitted image data and reflected image data.

$$\Sigma_{aij}-\Sigma_{bij}\geqq 0 \qquad \text{[Formula 1]}$$

Here, a is a numerical value assigned to a pixel of the transmitted image and (i, j) are the coordinates on the bill. A predetermined area is defined using the coordinates in advance and the total value of the pixels of the transmitted image of the predetermined area is derived. On the other hand, b is a numerical value assigned to a pixel of the reflected image and the total value of the pixels of the reflected image of the predetermined area is similarly derived.

As in the above mathematical equation, if the total (or possibly average) brightness of the transmitted image is higher than that of the reflected image in a predetermined area, it is assumed that the transmitted image is brighter in the predetermined area and some state change (being wet or pierced) has occurred; then, the predetermined area is excluded from the actual authenticity judgment process.

In this embodiment, the above predetermined area is set up in an area other than areas where irradiation with light of different wavelengths from a light emitting part leads to different image information (such an area is termed a characteristic area). In other words, since the areas where irradiation with light of different wavelengths from a light emitting part (a first light emitting part 80*a* and a second light emitting part 81*b*) leads to different image information are considered to be important for the actual bill authenticity judgment, other areas are excluded from the actual authenticity judgment as the above predetermined area. For this reason, if the total (or possibly average) brightness of the transmitted image is higher than that of the reflected image in a characteristic area, that characteristic area is not excluded from the authenticity judgment process.

This is because it is less likely that the above state change in a non-characteristic area (a predetermined area) particularly affects the authenticity judgment. Such non-characteristic areas are assigned to the above predetermined area so as to prevent reduction in the accuracy of authenticity judgment.

Here, the above characteristic areas of a bill can be, for example, areas where a watermarked image is formed. Furthermore, in the event that a characteristic area of a bill is wet, in other words that the total (or possibly average) brightness of the transmitted image is higher than that of the reflected image in a characteristic area, the bill can immediately be discharged.

Then, in the actual authenticity judgment process, comparison is made between reference pixel data regarding a legitimate bill and stored in advance in a ROM and the like and pixel data obtained by irradiating the printed area on the surface of a conveyed bill with light of a given wavelength from a light emitting part (a first light emitting part 80*a* and a second light emitting part 81*b*) and consisting of the transmitted light data from light transmitted through the bill and the reflected light data from light reflected by the bill. As described above, even if the above equation is satisfied for the predetermined area at the previous step to the authenticity judgment process, it is assumed that the state change has occurred to a legitimate bill and the predetermined area is excluded from the comparison with reference data (reference data from which the predetermined area is excluded in advance) in the actual authenticity judgment process.

Next, the bill housing part 100 that stacks and houses sequentially bills thus-identified authentic by the bill reading means 8 will be explained.

As shown in FIGS. 3 to 5, the main body frame 100A constituting the bill housing part 100 is formed into a substantially rectangular parallelepiped (or cuboid) shape, and one end of bias means (e.g., bias spring) 106 is attached to an interior side of a front wall 102*a* thereof, and a placing plate 105 on which bills to be fed via the above-described receiving port 103 are sequentially stacked is provided to the other end thereof. Therefore, the placing plate 105 is in a state that it is pressed toward the presser plate 115, which will be described later, by the bias means 106.

In the main body frame 100A, a press standby part 108 that keeps a dropping bill as it falls is provided so as to continuously communicate with the receiving port 103. A pair of regulatory members 110 are disposed on both sides of the press standby part 108, respectively, the regulatory members 110 extending in a vertical direction. An opening is formed between the pair of regulatory members 110 such that the presser plate 115 passes through the opening as bills are successively stacked onto the placing plate 105.

Further, the presser plate 115 that presses toward the placing plate 105 a bill falling into the press standby part 108 from the receiving port 103 is installed in the main body frame 100A. The presser plate 115 is formed in such a size that it may be capable of reciprocating through an opening formed between the pair of regulatory members 110, and gets into the opening so as to be driven to reciprocate between a position where the bills are pressed against the placing plate 105 (a pressing position) and another position where the press standby part 108 is opened (an initial position). In this case, the bill passes through the opening as being flexibly bent in a pressing operation of the presser plate 115 and is then placed on the placing plate 105.

The presser plate 115 is driven to reciprocate as described above via a presser plate driving mechanism 120 installed in the main body frame 100A. The presser plate driving mechanism 120 comprises a pair of link members 115*a* and 115*b* having respective ends thereof supported pivotally by the presser plate 115 so as to allow the presser plate 115 to reciprocate in an arrow A direction in FIGS. 3 and 4, and these link members 115*a* and 115*b* are connected in a shape of letter "X", and the other ends opposite to the respective ends are supported pivotally by a movable member 122 installed movably in a vertical direction (an arrow B direction). A rack is formed in the movable member 122, and a pinion constituting the presser plate driving mechanism 120 is geared (engaged) with the rack.

As shown in FIG. 4, a housing part side gear train 124 constituting the presser plate driving mechanism 120 is connected to the pinion. For this case, as shown in FIG. 4, in this embodiment, a driving source (a motor 20) and a main body side gear train 21 sequentially engaged with the motor 20 are installed in the above-described apparatus main body 2, and when the bill housing part 100 is mounted to the apparatus main body 2, the main body side gear train 21 is to be connected to the housing part side gear train 124. That is, the housing part side gear train 124 comprises a gear 124B installed on the same axis of the pinion and gears 124C, 124D to be engaged sequentially with the gear 124B, and when the bill housing part 100 is mounted to and demounted from the apparatus main body 2, the gear 124D is configured to be engaged with and disengaged from a final gear 21A of the main body side train 21.

As a result therefrom, the presser plate 115 is driven to reciprocate in the arrow A direction as the motor 20 installed in the apparatus main body 2 is driven to rotate so as to drive the main body side train 21 and in turn the presser plate driving mechanism 120 (the housing part side gear train 124, the rack installed onto the movable member 122, and the link members 115*a*, 115*b*, etc.).

Conveyor members 150 which are capable of touching the bill conveyed-in from the receiving port 103 are installed in the main body frame 100A. The conveyor members 150 take their own role to contact the bill conveyed-in so as to stably guide the bill to an appropriate position in the press standby part 108 (position where the bill can be stably pressed without causing the bill to be moved to the right or left side when the bill is pressed by the presser plate 115). In this embodiment, the conveyor members are constituted of belt-like members (hereafter called belts 150) installed so as to face the press standby part 108.

In this case, the belts 150 are installed so as to extend along the conveying-in direction with respect to the bill, and are wrapped around the pair of pulleys 150A and 150B supported rotatably on both ends in the conveying-in direction. Further, the belts 150 contact a conveyor roller 150C extending in an axis direction which is supported rotatably in the region of the receiving port 103, and the belts 150 and the conveyor roller 150C nip and hold the bill conveyed-in the receiving port 103 therebetween to guide the bill directly to the press standby part 108. Moreover, in this embodiment, the pair of belts 150 are provided on the right and left sides, respectively, across the above-described presser plate 115 in order to be capable of contacting the surface on left and right sides of the bill. Here, the belts 150 may be prevented from loosening by not only being wrapped around the pulleys 150A and 150B at the both ends, but also causing tension pulleys to push the belts 150 at the intermediate positions, respectively.

The pair of belts 150 are configured to be driven by the motor 13 that drives the above-described plurality of conveyor rollers installed in the apparatus main body 2. In detail, as shown in FIG. 5, the above-described driving belt 13B driven by the motor 13 is wrapped around a pulley 13D for the driving force transmission, and a gear train 153 installed at the end of the spindle of the pulley 150A supported rotatably on the receiving port 103 side is engaged with a gear train 13E for the power transmission sequentially installed onto the pulley 13D. That is, when the bill housing part 100 is mounted to the apparatus main body 2, an input gear of the gear train 153 is configured to be engaged with a final gear of the gear train 13E, and the pair of belts 150 are configured to be driven to rotate in a synchronized manner with the above-described conveyor rollers 14B, 15B 16B, and 17B for conveying the bill by driving the motor 13 to rotate.

As described above, when the bill is inserted into the inside via the bill insertion slot 5, the bill is moved inside the bill traveling route 3 by the bill conveyance mechanism 6. The bill traveling route 3 is extended from the bill insertion slot 5 toward the back side, as shown in FIG. 3, and comprises a first traveling route 3A and a second traveling route 3B which is extended from the first traveling route 3A toward downstream side and is inclined at a predetermined angle to the first traveling routes 3A.

Further, a pull-out preventing member (shutter member) 170 that prevents the bill from being conveyed toward the bill insertion slot 5 is installed in the second traveling route 3B. The pull-out preventing member 170 is biased to rotate in the arrow direction of FIG. 3 (a direction in which the second traveling route 3B is closed) via a spindle 170*a*, and when the bill moves toward the side of the bill housing part 100, the pull-out preventing member 170 is rotated so as to open the second traveling route against the biasing force, and when the bill once passes through the second traveling route, the pull-out preventing member 170 is rotated in the arrow direction to close the second traveling route 3B. That is, when the rear end of the bill passes through the pull-out preventing member 170, the second traveling route 3B is closed by the pull-out preventing member 170, not to allow the bill to be drawn out.

In addition, such pull-out preventing members may be installed at a plurality of places along the traveling route on the downstream side of the bill reading means 8. Further, their installing positions may be on the side downstream from the position at which the bill is stopped at the time of carrying out the bill authenticity judgment process (an escrow position; a position on the downstream side by approximately 13 mm from the bill reading means 8 in this embodiment).

Next, control means 200 that controls the driving of the bill conveyance mechanism 6, the bill reading means 8 and the like as mentioned above will be described with reference to a block diagram of FIG. 6.

Figure 6:
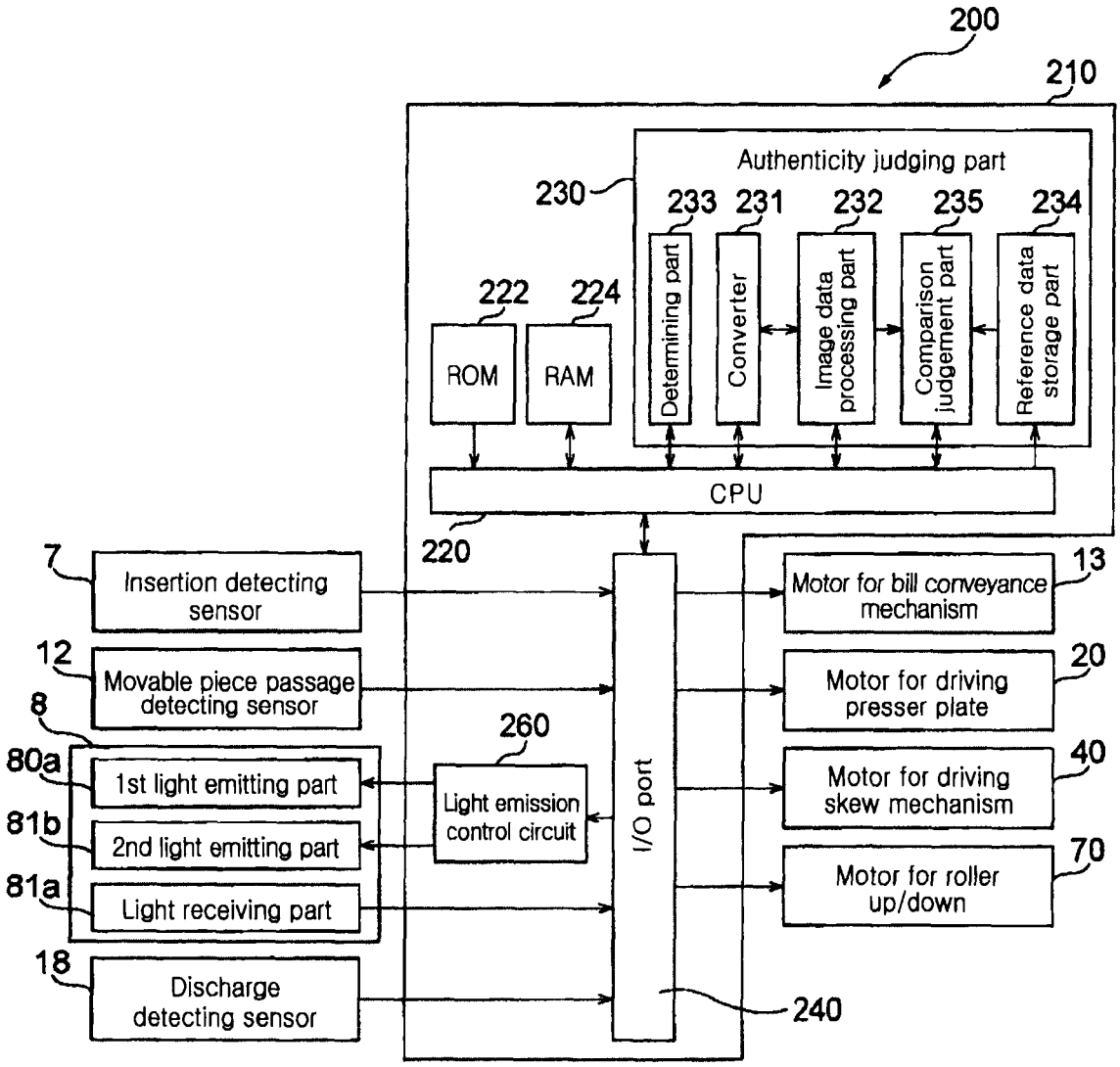
Figure 7:
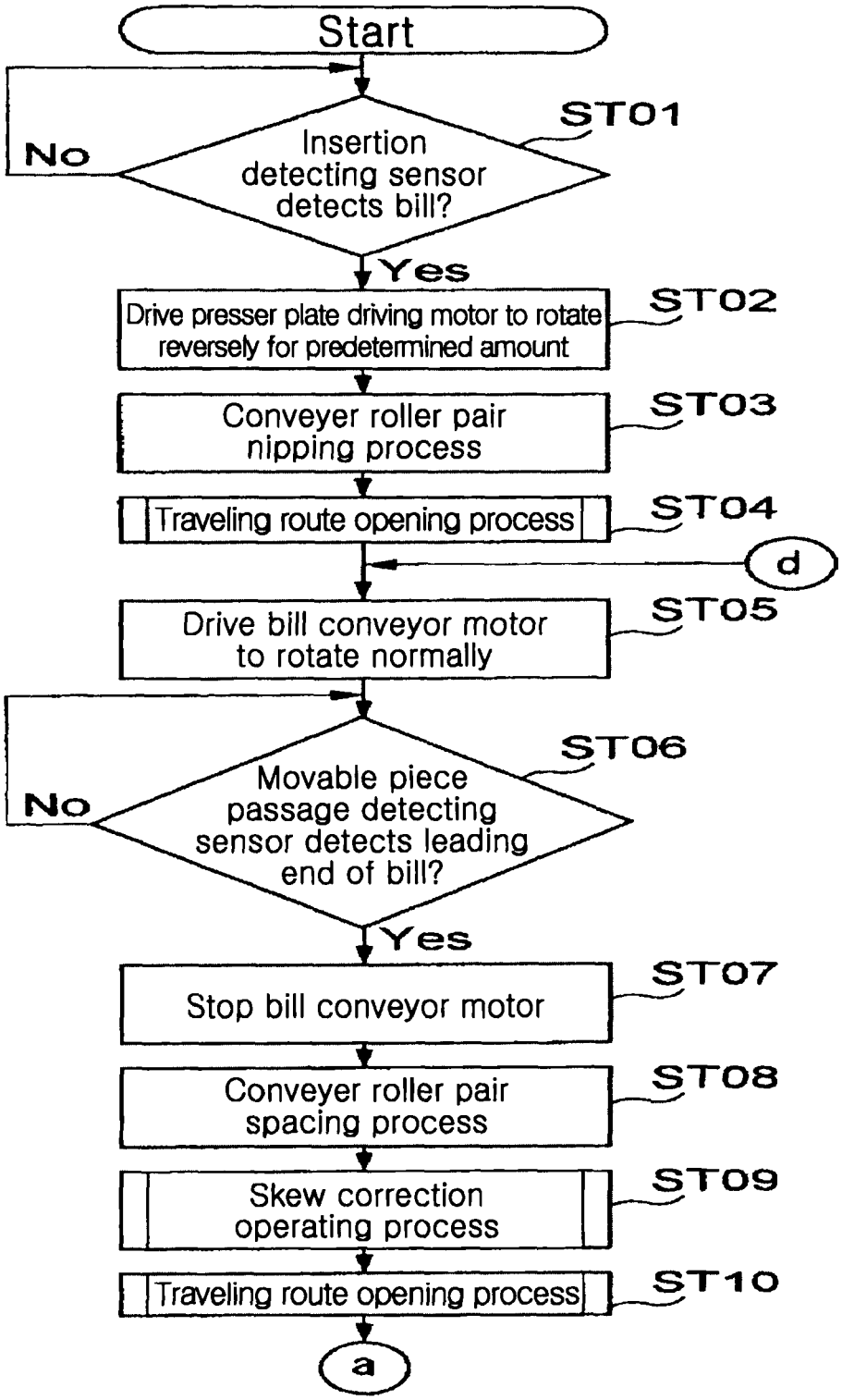
FIG. 7 shows a flowchart (part one) illustrating processing operations for processing the bill in the bill processing apparatus of this embodiment.
Figure 8:
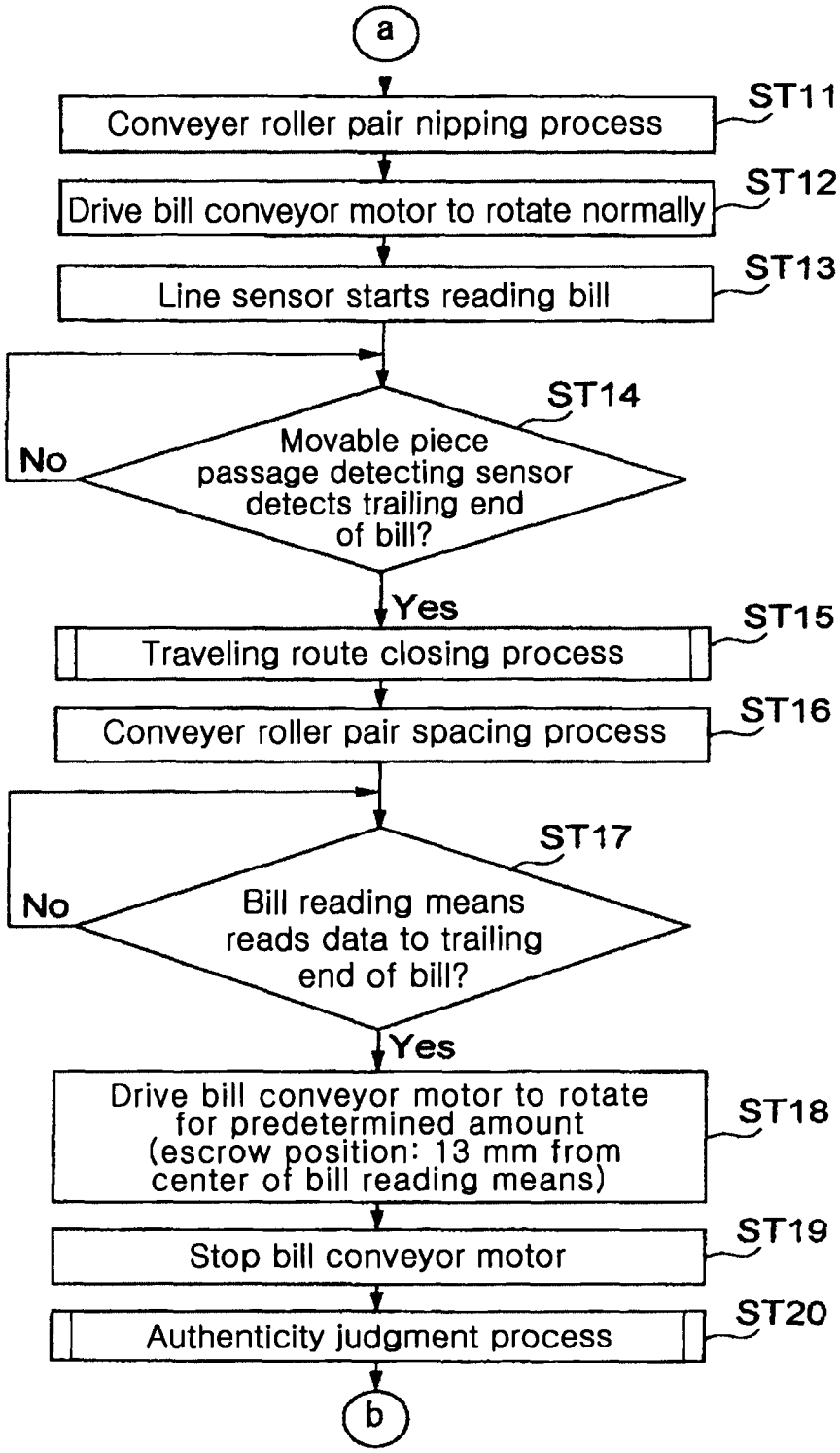
FIG. 8 shows a flowchart (part two) illustrating processing operations for processing the bill in the bill processing apparatus of this embodiment.
Figure 9:
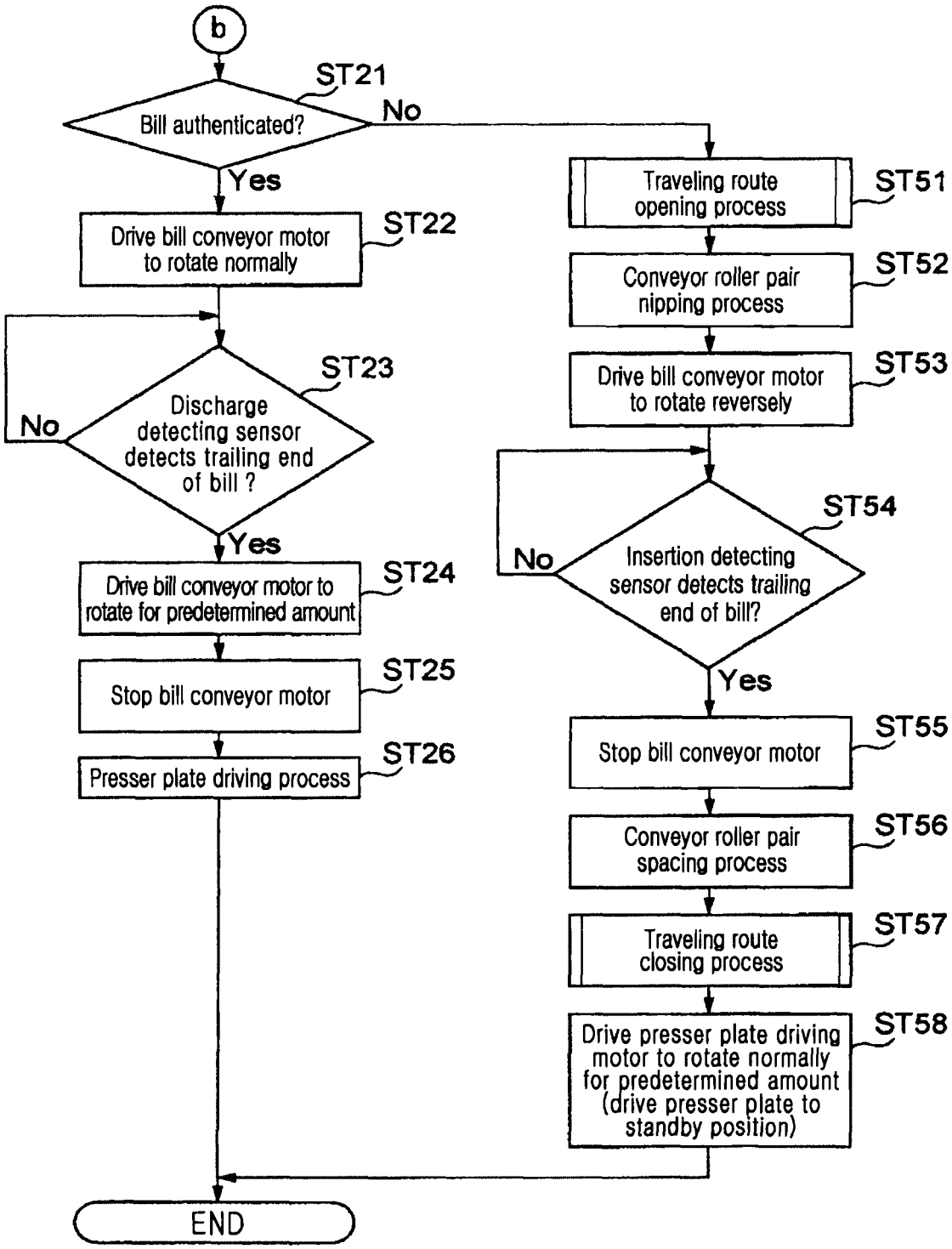
FIG. 9 shows a flowchart (part three) illustrating processing operations for processing the bill in the bill processing apparatus of this embodiment.
Figure 10:
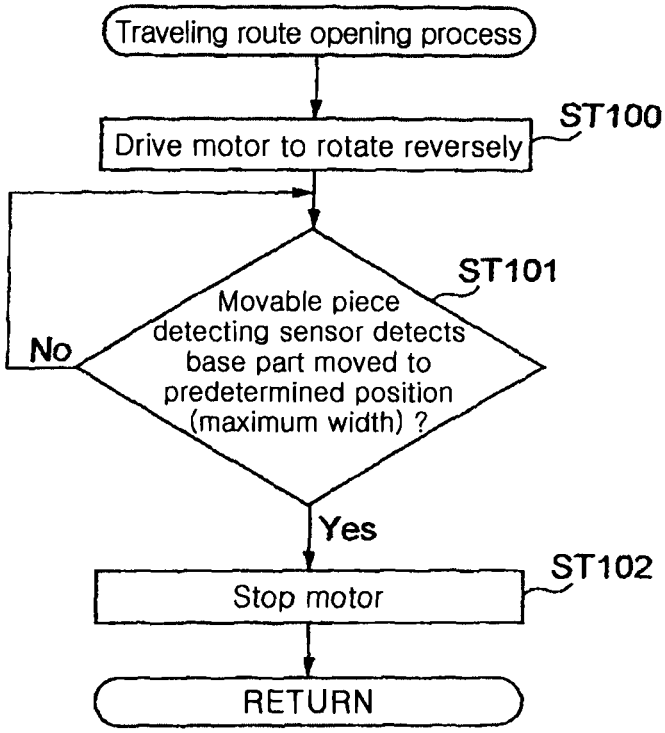
FIG. 10 shows a flowchart illustrating processing operations of a traveling route opening process.

The control means 200 as shown in a block diagram of FIG. 6 comprises a control board 210 which controls the operations of the above-described respective drive units, and a CPU (Central Processing Unit) 220 controlling driving of each drive unit and constituting the bill identification means, a ROM (Read Only Memory) 222, a RAM (Random Access Memory) 224, and an authenticity judging part 230 are implemented on the control board 210.

In the ROM 222, permanent data such as various types of programs such as a multi-feed judging program for judging a double feed or a folded feed at a leading end portion of the bill; an authenticity judgment program by the authenticity judging part 230, operation programs for the respective drive units such as the motor 13 for the bill conveyance mechanism, the motor 20 for the presser plate, the motor 40 for the skew correction mechanism, and the roller up-and-down motor 70 for lifting up and down rollers; and the like are stored.

The CPU 220 operates according to the programs stored in the ROM 222, and carries out input and output of the signals with respect to the respective drive units described above via an I/O port 240, so as to perform the entire operational control of the bill processing apparatus. That is, the motor 13 for the bill conveyance mechanism, the motor 20 for the presser plate, the motor 40 for the skew correction mechanism, and the roller up-and-down motor 70 are connected to the CPU 220 via the I/O port 240, and the operations of these drive units are controlled by control signals transmitted from the CPU 220 in accordance with the operation programs stored in the ROM 222. Further, the CPU 220 is so configured that detection signals from the insertion detecting sensor 7, the movable piece passage detecting sensor 12, and the base part detecting sensor 18 are input into the CPU 220 via the I/O port 240, and the driving of the respective drive units is controlled based on these detection signals.

Moreover, the CPU 220 is so configured that a detection signal based on the transmitted light and the reflected light of the light which is irradiated to the bill as the identification object is input into the CPU 220 via the I/O port 240 from the light receiving part 81*a* in the bill reading means 8 as described. The first light emitting part 80*a* and the second light emitting parts 81*b* in the bill reading means 8 are controlled through a light emission control circuit 260 by a control signal from the CPU 220 in accordance with the operation programs stored in the abovementioned ROM 222 such that the lighting interval and the turning-off are controlled.

The RAM 224 temporarily stores data and programs used for the CPU 220 to operate, and also acquires and temporarily stores the received light data of the bill serving as the identification object. Furthermore, the RAM 224 stores transmitted image data consisting of multiple pixels converted by a converter 231 described later from the transmitted light received by the light receiving part 81*a* and reflected image data consisting of multiple pixels converted by the converter 231 from the reflected light received by the light receiving part 81*a*.

The authenticity judgment processing part 230 judges whether the conveyed bill is illegitimate. The authenticity judgment processing part 230 comprises a converter 231 converting the received light data of an identification object that are stored in the RAM 224 to pixel information containing color information (density value) including brightness on the basis of pixels, an image data processing part 232 acquiring image data based on the pixel information converted by the converter 231, and a determining part 233 comparing the brightness of the pixels of the transmitted image of the above predetermined area with the brightness of the pixels of the reflected image corresponding to the predetermined area of the transmitted image and, based on the comparison results, excluding the predetermined area from the authenticity judgment. Therefore, when the determining part 233 determines that the brightness of the transmitted image of the predetermined area is higher than the brightness of the reflected image of the same predetermined area based on the above mathematical equation, the image data processing part 232 receives image data from which the image data from the transmitted light and image data from the reflected light that are obtained in the predetermined area are excluded.

Further, the bill determination processing part 230 comprises: a reference data storage part 234 in which the reference data of the legitimate bill (pixel data of the legitimate bill) is stored, and a comparison judgment part 235 which compares the image data (pixel data) of the bill acquired by the image data processing part 232 with the reference data (reference pixel data) stored in the reference data storage part 234, and carries out the determination process to determine whether the bill being conveyed is legitimate or not.

In this case, the reference data storage part 234 stores image data about the legitimate bill to be used, when the above-mentioned authenticity judgment process is carried out, and image data relating the legitimate bill excluding the predetermined area as mentioned above. In other words, although reference data include image data of a predetermined area in the conventional authenticity judgment process, the determining part 233 uses the reference data consisting of image data excluding the predetermined area when the predetermined area is excluded. The reference data storage part 234 further stores various reference data used for the authenticity judgment on the basis of money classes such as reference values on print lengths regarding legitimate bills.

Here, data which can be the reference data is stored in the dedicated reference data storage part 234. However, the data may be stored in the above-mentioned ROM 222.

The actual authenticity judgment process in the above-mentioned authenticity judgment processing part 230 is performed by irradiating a printing area on the surface of the bill being conveyed with light of a predetermined wavelength from the light emitting part (first light emitting part 80*a* and second light emitting part 81*b*), converting the reflected light data of the light reflected and the transmitted light data of the light transmitted from the bill into a plurality of pixel data having the brightness data per a predetermined size as the unit in the converter 231, and comparing such data with the reference pixel data of the legitimate bill stored in advance with the reference data storage part 234. In addition, when the determining part 233 determines that the state change is made in the predetermined area of the bill as described above, the authenticity judgment process is executed as the image data of the bill excluding the predetermined areas is acquired.

Next, the bill processing operation in the bill processing apparatus 1 executed by the control means 200 will be described according to the flowcharts of FIGS. 7 to 13.

When an operator inserts a bill into the bill insertion slot 5, the conveyor roller pair (14A and 14B) installed in the vicinity of the bill insertion slot is in a state that the rollers are spaced from each other in an initial stage (refer to ST18 and ST58 to be described later). Further, with respect to the presser plate 115, the pair of link members 115*a* and 115*b* driving the presser plate 115 are located at the press standby part 108, and the presser plate 115 is positioned in the standby position such that the bill cannot be conveyed-in the press standby part 108 from the receiving port 103 by the pair of link members 115*a* and 115*b*. That is, in this state, the presser plate 115 is brought into the opening formed between the pair of regulatory members 110 such that the condition is so made as to prevent the bills stored in the bill housing part from being drawn out through the opening.

Moreover, the pair of movable pieces 10A constituting the skew correction mechanism 10 located on the downstream side of the conveyor roller pair (14A, 14B) are in a state that the pair of movable pieces 10A are moved to leave the minimum open width therebetween (for example, an interval between the pair of movable pieces 10A is 52 mm; refer to ST15 and ST57 to be described later) so as to prevent the bill from being drawn out in the initial stage.

In the initial state of the above-described pair of conveyor rollers (14A and 14B), it is possible for the operator to easily insert even a bill having wrinkles into the paper sheet insertion slot 5. Then, when insertion of the bill is detected by the insertion detecting sensor 7 (ST01), the driving motor 20 of the above-described presser plate 115 is driven to rotate reversely for a predetermined amount (ST02) to move the presser plate 115 to the initial position. That is, the presser plate 115 is in a state that the presser plate 115 is moved and remains in the opening formed between the pair of regulatory members 110 such that it is so arranged that the bill cannot pass through the opening until the insertion of another bill is detected by the insertion detecting sensor 7.

When the presser plate 115 is moved from the standby position to the initial position, the press standby part 108 becomes in an open state (refer to FIG. 4) such that the apparatus is in a state that the bill can be conveyed into the bill housing part 100. That is, by driving the motor 20 to rotate reversely for a predetermined amount, the presser plate 115 is moved from the standby position to the initial position via the main body side gear train 21 and the presser plate driving mechanism 120 (the housing part side gear train 124, the rack formed on the movable member 122, and the link members 115*a*, 115*b*).

Further, the above-described roller up-and-down motor 70 is driven to move the upper conveyor roller 14A so as to make a contact with the lower conveyor roller 14B. In accordance therewith, the inserted bill is nipped and held therebetween by the pair of conveyor rollers (14A and 14B) (ST03).

Next, a traveling route opening process is conducted (ST04). The opening process is conducted by driving the pair of movable pieces 10A to move in separating directions so as to become apart with each other as the motor 40 for the skew correction mechanism is driven to rotate reversely as shown in the flow chart of FIG. 10 (ST100). At this time, when it is detected that the pair of movable pieces 10A have moved to the predetermined positions (the maximum open width positions) by the movable piece detecting sensor (ST101), the driving operation to rotate the motor 40 reversely is stopped (ST102). This traveling route opening process makes the skew correction mechanism in such a condition as to allow the paper sheet to enter between the pair of movable pieces 10A. In addition, in the previous step of ST04, the bill traveling route 3 is in a closed state by a traveling route closing process (ST15, ST57) to be described later. Thus, the bill traveling route 3 is closed in this way before an insertion of the bill so as to prevent an element such as a line sensor from being broken by, for example, inserting a plate-like member from the bill insertion slot for illicit purposes or the like.

Next, the bill conveyor motor 13 is driven to rotate normally (ST05). The bill is conveyed into the inside of the apparatus by the conveyor roller pair (14A and 14B), and when the movable piece passage detecting sensor 12 installed on the downstream side from the skew correction mechanism 10 detects the leading end of the bill, the bill conveyor motor 13 is stopped (ST06 and ST07). At this time, the bill is located between the pair of movable pieces 10A constituting the skew correction mechanism 10.

Subsequently, the above-described roller up-and-down motor 70 is driven to allow the conveyor roller pair (14A and 14B) holding the bill therebetween to become apart from each other (ST08). At this time, the bill is in a state that no load is applied.

Figure 11:
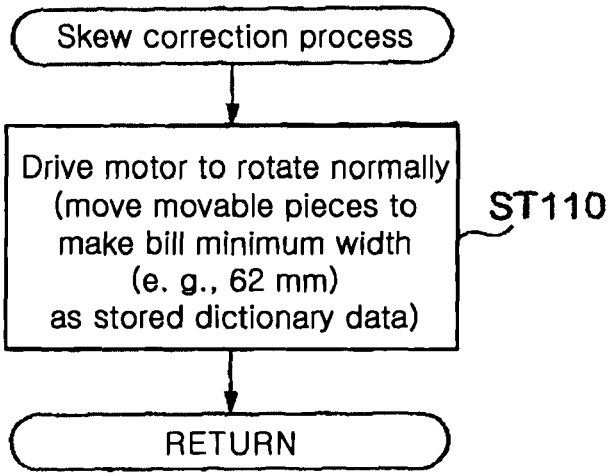
FIG. 11 shows a flowchart illustrating processing operations of a skew correction operating process.

Then, a skew correction operating process is executed as the paper sheet remains in this state (ST09). The skew correction operating process is conducted by driving the motor 40 for the skew correction mechanism to rotate normally to drive the pair of movable pieces 10A to get closer with each other. That is, in this skew correction operating process, as shown in the flowchart of FIG. 11, the motor 40 described above is driven to rotate normally to move the pair of movable pieces 10A in respective directions such that the pair of movable pieces 10A get closer with each other (ST110). The movement of the movable pieces is continued until the distance therebetween becomes the minimum width (for example; width of 62 mm) of the bill registered in the reference data storage part in the control means. And the skew is corrected by the movable pieces 10A touching both sides of the bill such that the bill may be positioned at the accurate center position.

When the skew correction operating process as described above is completed, a traveling route opening process is subsequently executed (ST10). This process is conducted by moving the pair of movable pieces 10A in separating directions as the above-described motor 40 for the skew correction mechanism is driven to rotate reversely (refer to ST100 to ST102 of FIG. 10).

Subsequently, the above-described roller up-and-down motor 70 is driven to move the upper conveyor roller 14A to contact the lower conveyor roller 14B, and the bill is nipped and held between the pair of conveyor rollers (14A and 14B) (ST11). Thereafter, the bill conveyor motor 13 is driven to rotate normally to convey the bill into the inside of the apparatus, and when the bill passes through the bill reading means 8, a reading process of the bill is executed (ST12 and ST13).

Figure 12:
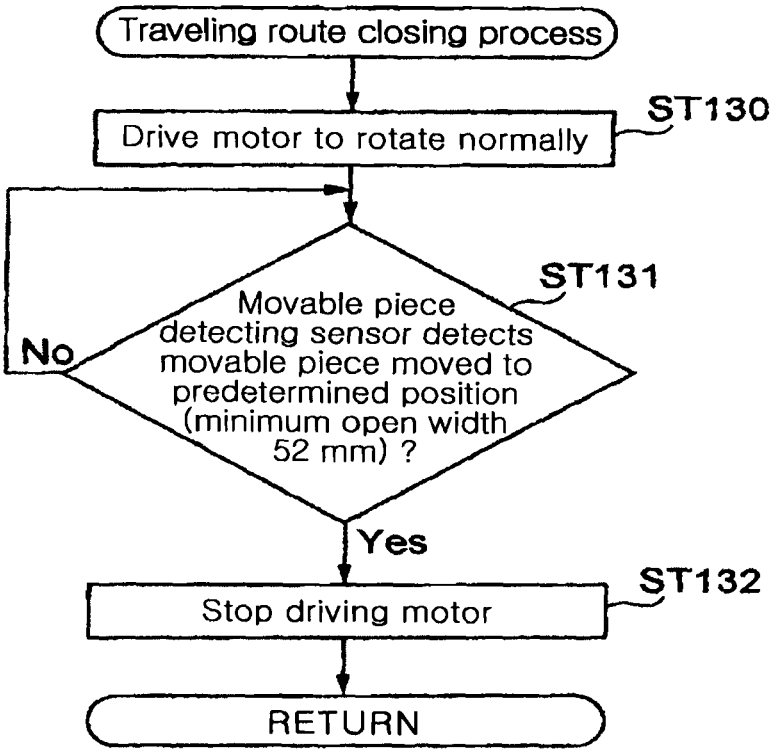
FIG. 12 shows a flowchart illustrating processing operations of a traveling route closing process.

Then, when the bill to be conveyed passes through the bill reading means 8, and the trailing end of the bill is detected by the movable piece detecting sensor 12 (ST14), a process for closing the bill traveling route 3 is executed (ST15). In this process, first, as shown in the flowchart of FIG. 12, after the trailing end of the bill is detected by the movable piece detecting sensor 12, the above-described motor 40 is driven to normally rotate to move the pair of movable pieces 10A in the directions that they get closer to each other (ST130). Next, when it is detected by the movable piece detecting sensor that the movable pieces 10A move to the predetermined positions (minimum open width positions: for example, width of 52 mm) (ST131), the driving operation of the normal rotation of the motor 40 is stopped (ST132).

With this traveling route closing process, the pair of movable pieces 10A are moved to the positions of the minimum open width (width of 52 mm) narrower than the width of any bill allowed to be inserted, thereby effectively preventing the bill from being drawn out. That is, by executing such a bill traveling route closing process, an opening distance between the movable pieces 10A is made shorter than the width of the inserted bill, thereby enabling the effective prevention of an action of drawing-out the bill in the direction toward the insertion slot by the operator for illicit purposes.

In succession to the traveling route closing process described above (ST15), a conveyor roller pair spacing process in which the driving source 70 is driven to allow the conveyor roller pair (14A and 14B) coming to hold the paper sheet therebetween to be spaced from one another is executed (ST16). By executing the conveyor roller pair spacing process, even if the operator additionally inserts (double insertion) another bill by mistake, the bill is not subject to a feeding operation by the conveyor roller pair (14A and 14B) and hits front ends of the pair of movable pieces 10A in a closed state according to ST15 such that it is possible to reliably prevent the operation of bill double-insertion.

Along with the bill traveling route closing process as mentioned above, when the bill reading means 8 reads the data up to the trailing end of the bill, the bill conveyor motor 13 is driven for a predetermined amount and stops the bill in a predetermined position (an escrow position; a position where the bill is conveyed toward the downstream by 13 mm from the center position of the bill reading means 8), and at this time, an authenticity judgment process of the bill is executed in the comparison judgment part 234 by referring to the reference data stored in the reference data storage part 233 in the bill determination processing part 230 of the aforementioned control means 200 (ST17 to ST20).

Figure 13:
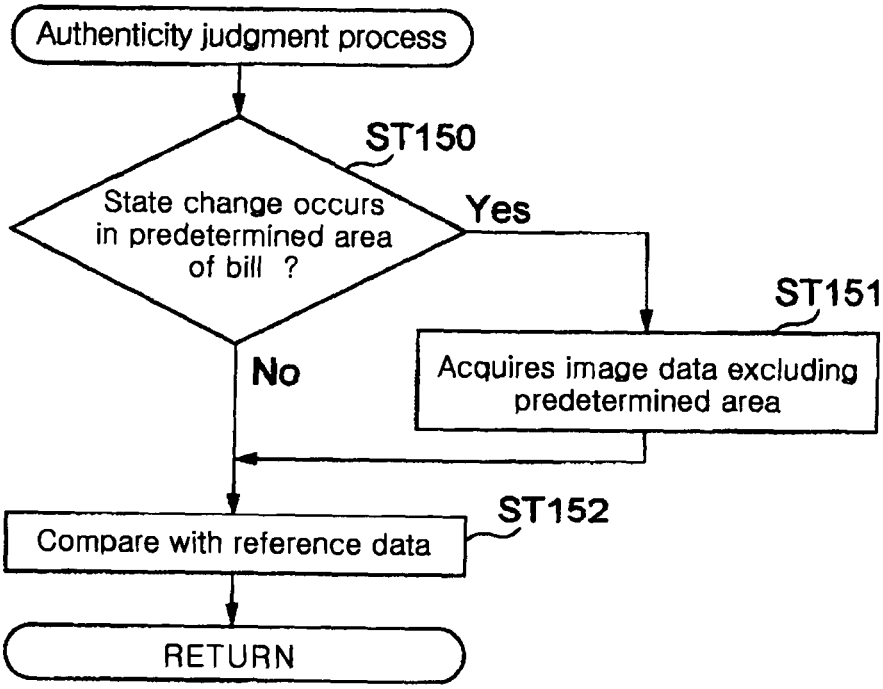
FIG. 13 shows a flowchart illustrating processing operations of a bill authenticity judgment process.

In the authenticity judgment process, first, as shown in the flowchart of FIG. 13, the determining part 233 compares the brightness of the pixels of the transmitted image of a predetermined area of a bill with the brightness of the pixels of the reflected image corresponding to the predetermined area of the transmitted image and determines whether the predetermined area has some state change (ST150). This determination is made by comparing the total brightness of the transmitted image of the predetermined area and the total brightness of the reflected image of the same predetermined area based on the above mathematical equation. Then, if it is determined that there is no state change (ST150; No), the image data processing part 232 acquires image data including the predetermined area and the comparison judgment part 235 compares them with the reference data stored in the reference data storage part 234 (ST152). On the other hand, if the determining part 233 determines that the predetermined area has some state change (ST150; Yes), the image data processing part 232 acquires image data excluding the predetermined area (ST151) and the comparison judgment part 235 compares them with the reference data (reference data excluding the predetermined area) stored in the reference data storage part 234 (ST152).

Then, in the bill authenticity judgment process at ST20 as described above, when the bill is judged as a legitimate bill (ST21; Yes), the motor 13 for the bill conveyance is rotated normally (ST22). While the bill is conveyed, the bill conveyor motor 13 is driven to rotate normally until the back end of the bill is detected by the discharge detecting sensor 18 (ST23), and after the back end of the bill is detected by the discharge detecting sensor 18, the bill conveyor motor 13 is driven to rotate normally by the predetermined amount (ST24 and ST25).

The process for driving the bill conveyor motor 13 to rotate normally in ST24 and ST25 corresponds to a driving amount for which the bill is conveyed in the receiving port 103 of the bill housing part 100 from the discharge slot 3*a* on the downstream side of the bill traveling route 3 of the apparatus main body 2 so that the pair of belts 150 contact the surface on both sides of the conveyed-in bill to guide the bill stably to the press standby part 108. That is, by further driving the bill conveyor motor 13 to rotate normally for a predetermined amount after the trailing end of the bill is detected by the discharge detecting sensor 18, the pair of belts 150 contact the bill conveyed-in and are driven in the bill feeding direction so as to guide the bill in a stable state to the press standby part 108.

Then, after the above-described bill conveyor motor 13 is stopped, the process for driving the presser plate 115 is executed (ST26) such that the bill is placed on the placing plate 105. And, after the pressing process is completed, the presser plate 115 is again moved to the standby position and stopped to the position.

Also, in the process of ST21 as described above, when the inserted bill is judged as a non-legitimate bill (ST21; No), a traveling route opening process is executed (ST51, refer to ST100 to ST102 of FIG. 10), then, the bill conveyor motor 13 is driven to rotate reversely, and the conveyor roller pair (14A and 14B) are brought into contact with each other such that the bill waiting at the escrow position is conveyed toward the bill insertion slot 5 (ST52 and ST53). Then, when the insertion detecting sensor 7 detects the trailing end of the bill to be returned toward the bill insertion slot 5, the driving to reversely rotate the bill conveyor motor 13 is stopped, and above-described roller up-and-down motor 70 is driven to make the conveyor roller pair (14A and 14B) in a state of nipping and holding the bill therebetween separate from each other (ST54 to ST56). After that, the traveling route closing process is executed (refer to ST57, and ST130 to ST132 in FIG. 12) and the driving motor 20 for the presser plate 115 is driven to rotate normally (ST58) such that the presser plate 115 positioned at the initial position is driven to move to the standby position, and then a series of processes are completed.

In the bill processing apparatus having the above configuration, when a bill that is legitimate but has some state change in a predetermined area is inserted, first, the determining part determines whether there is some state change (being wet or defective, such as being pierced) and, when there is some state change, excludes the predetermined area from the authenticity judgment. In this way, it is less likely that a legitimate bill will be judged to be a forged bill because of its state change and the accuracy of authenticity judgment can be improved.

Particularly, in this embodiment, a predetermined area of a bill is set up in areas other than the characteristic areas where irradiation with light of different wavelengths from the light emitting part constituting the bill reading means leads to different pixel information (the areas important for judging the authenticity of a bill). Even if the above state change has occurred in the predetermined area, it is less likely that the state change affects the authenticity judgment, preventing reduction in the accuracy of authenticity judgment.

Furthermore, in the above-described embodiment, the light receiving part is composed of a line sensor reading a bill across the entire width. Then, the above predetermined area and characteristic area s can precisely be identified, further improving the accuracy of authenticity judgment.

Figure 14:
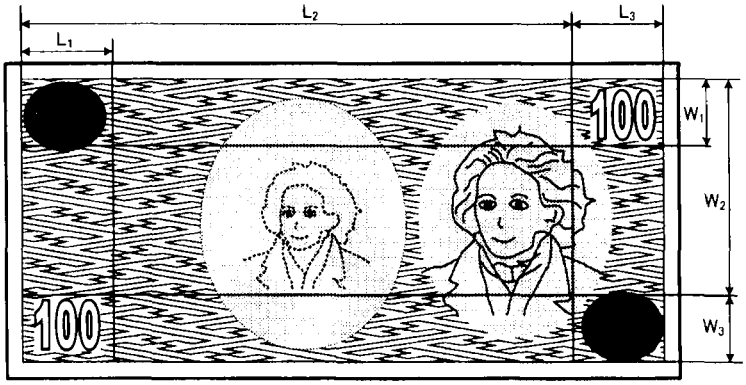
FIG. 14 is a schematic diagram of a reflected light image of a bill, which is divided into small areas.

In an embodiment, the above predetermined area can be an area situated at a given position in the printed area excluding the watermarked parts and having a given size. In an image from the reflected light of a bill as shown in FIG. 14, the given position is at a distance L1 from the left end and at a distance W1 from the top end of the printed area. In other words, the given size is L1×W1. This area can be treated as a monetary amount display area based on which the bill class is easily identified. Particularly, it is not always necessary to have characteristics such as light wavelength-dependent reflectance or transmittance. Conversely, there is no inconvenience in treating this area as a visually identifiable money class data area. Then, the reference data for authenticity judgment can be extracted based on the money class data. Similarly, the given position can be at a distance L3 from the right end and at a distance W3 from the bottom end of the printed area. Alternatively, the predetermined area can be at these two positions (multiple positions). In FIG. 14, it is seen that these areas are wet and the intensity of reflected light is lower. However, it is satisfactory that the money class, 100, is identified from these areas. These areas can be excluded from the subsequent authenticity judgment process.

Figure 15:
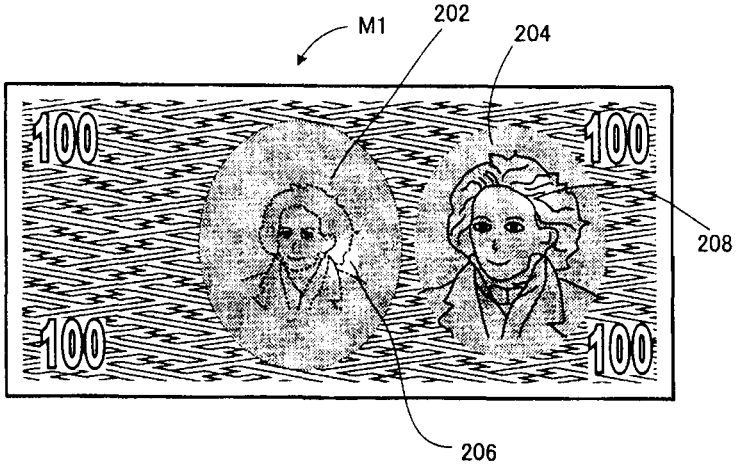
FIG. 15 is a schematic diagram of a transmitted light image of a bill.
Figure 16:
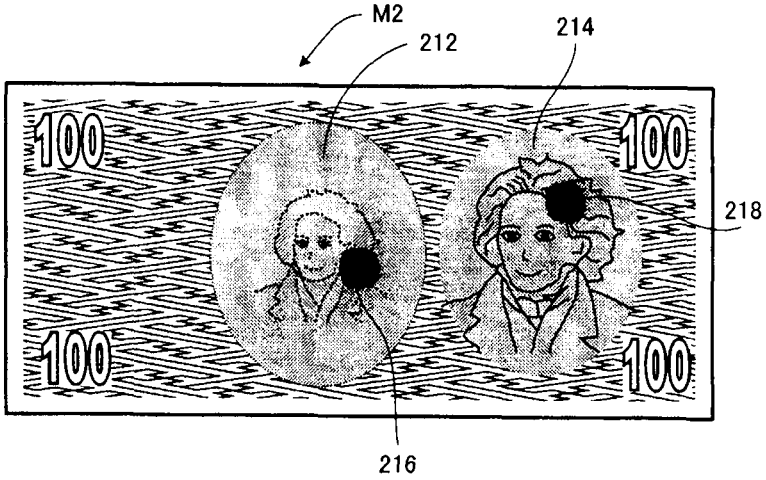
FIG. 16 is a schematic diagram of a reflected light image of a bill.

In regard to reading a bill as described above, more specific bill conditions will be described in another embodiment. FIGS. 15 and 16 schematically show wet bills. FIG. 15 schematically shows an image from the light transmitted through a bill M1 and FIG. 16 schematically shows an image from the light reflected by a bill M2. Here, both figures are top views of the bills seen from above (in the direction of the incident light). In other words, the transmitted light is viewed after it is reflected by a reflecting plate. In this way, the transmitted light image can be superimposed on the reflected light image for easier composition.

The bill has a watermarked part 202 or 212 nearly in the center (the above characteristic area) as an important part for authenticity judgment and a portrait 202 or 214 to the right thereof, which allows for intuitive authenticity judgment by so-called reflected light identification. However, the wet parts 206 and 208 allow light to easily transmit and appear as white in FIG. 15. On the other hand, the reflected light shows similarly wet parts 216 and 218 as blackish, subdued parts because diffuse reflection is reduced on their surfaces. For this reason, the transmitted light is brighter in such parts and the identification based on the brightness of images may not be conducted adequately. The watermarked parts 202 and 212 are not non-characteristic parts and, therefore, not excluded from the authenticity judgment. Furthermore, when it is determined that such wetting has caused state change, the discharging process can immediately be conducted before the subsequent detailed review process starts. Assuming that the areas of the portraits 204 and 214 are non-characteristic area s, it is preferable that these parts are excluded from the authenticity judgment.

In discussion on the principle, presumably, the incident light energy Ei yields reflected light energy Er upon reflection on the surface of a bill, transmitted light energy Et upon transmission through the bill, or optically absorbed energy Ea absorbed by the bill. In other words, an equation $Ei=Er+Et+Ea$ is generally satisfied. Here, Ea is increased as the pixels are darker in color (closer to 255). The value of a pixel is presented by V (0 to 255). On the other hand, the optically absorbed energy Ea presumably does not greatly change by wetting; then, $Ea=\alpha Ei$ ($0<\alpha=k\cdot V<1$). Next, the reflected light energy Er is generally larger than the transmitted light energy Et; then, presumably $Et=\beta Er$ ($0<\beta<1$) in general. However, this relationship is inverted where it is wet; then, presumably $Et=\gamma Er$ ($0<\gamma<1$). Hence, $Ei=\alpha Ei+\beta Er+Er$. Then, $Er=(1-\alpha)/(1+\beta)\times Ei$. Furthermore, $Et=\beta Er$. Ei is presumably constant. The reflected light energy Er is determined by the absorptance and the ratio of transmission/reflection. On the other hand, in the wet parts, $Er=(1-\alpha)/(1+1/\gamma)\times Ei$ and then $Et=1/\gamma\times Er$.

Here, assuming that $k=2.7\times10^{-3}$, $\beta=0.50$, and $\gamma=0.67$, $Er=(1-2.7\times10^{-3}\times V)/(1+0.5)\times Ei$. Then, $Et=\beta Er=\beta\times(1-2.7\times10^{-3}\times V)/(1+0.5)\times Ei$. On the other hand, in the wet parts, $Er=(1-2.7\times10^{-3}\times V)/(1+1.5)\times Ei$. Then, $Et=1/\gamma\times Er=(1-2.7\times10^{3}\times V)/(1+1.5)/0.67\times Ei$. This matter is shown in the table of FIG. 17 in more specific numbers. The pixel position (x, y) is given by the column and row numbers. In the figure, a wet part 226 where the reflection and transmission trade places is enclosed by solid lines. As seen from the figure, the subtraction of transmitted light from reflected light yields a negative value and the transmitted light is more intense in the wet part 226. Such an area can be a predetermined area. Alternatively, a preset area including such an area can be a predetermined area (x=1 to 4, y=3 to 10). When the number of pixels in the area 226 (x=2 to 3, y=4 to 8) where the inversion has occurred has reached a given rate or higher (for example, 10/32 or higher), it can be assumed that the predetermined area has some state change. For example, in the above-described embodiment, some state change is assumed when the equation (1) is satisfied. Here, the number of pixels constituting a predetermined area (for example more than half the number) is used as a criterion. Furthermore, although a predetermined area can be a preset area such as empirically particularly often wet parts, a predetermined area can also be set up by determining the number of pixels constituting a predetermined area (continuous area) in advance with or without determining a shape such as a square in advance, and shifting the area where the above criterion is satisfied (more than half the number of pixels, satisfying the equation 1) little by little.

In the paper sheet processing apparatus having the above configuration, the determining part can determine whether the paper sheet has some state change (mainly being wet or defected such as pierced) based on the brightness of the pixels of the transmitted image of a predetermined area of the paper sheet and the brightness of the pixels of the reflected image corresponding to the predetermined area of the reflected image. When the paper sheet has some state change in the predetermined area, the predetermined area is excluded from the authenticity judgment and the possibility of a legitimate bill being judged to be a forged bill is reduced, improving the accuracy of authenticity judgment.

Furthermore, in the invention relating to the above embodiment, the predetermined area is characteristically set up in areas other than the characteristic areas where irradiation with light of different wavelengths from the light emitting part leads to different pixel information.

In the paper sheet processing apparatus having the above configuration, since the area where irradiation with light of different wavelengths from a light emitting part leads to different pixel information is an area presenting characteristics (characteristic area) in judging the authenticity of a paper sheet, the predetermined area is set up in other areas so as to be excluded from the authenticity judgment. In other words, if there is some state change in an area that is not a characteristic area (a non-characteristic area), it is less likely that the authenticity judgment is particularly affected. Therefore, the predetermined area is set up in such a non-characteristic area to prevent reduction in the accuracy of authenticity judgment. In this regard, the characteristic area of a paper sheet corresponds for example to a watermarked image as formed on a bill.

Furthermore, the light receiving part can consist of a line sensor reading a paper sheet across the entire width.

The paper sheet processing apparatus having the above configuration can acquire image information of the paper sheet across the entire width by the line sensor and the predetermined area and characteristic area are precisely identified, further improving the accuracy of authenticity judgment.

Furthermore, a paper sheet processing apparatus that is a possible embodiment of the present invention can comprises a light emitting part emitting light to a paper sheet, a light receiving part receiving transmitted light and reflected light that are light emitted from the light emitting part and transmitted through/reflected by the paper sheet, a processor capable of controlling the light emitting part and light receiving part, and a storage part connected to the processor. Here, the processor can numerically express the transmitted light and reflected light received by the light receiving part based on their brightness on the basis of pixels containing color information including brightness and having a given unit size, and store them in the storage part in association with the position of the pixel on the bill. Furthermore, it can compare the reflected light and transmitted light at each pixel position and, when they have a given relationship, store in the storage part the position in association with a marker for not using the pixel data at that position in the authentication process. Then, among the pixel data stored in the storage part, the pixel data at the position associated with the marker are excluded in judging the authenticity of paper sheets. The marker can be, for example, a so-called flag or additional attribute data. Preferably, the position and brightness of a pixel can be extracted using the marker.

Furthermore, the processor may be allowed to judge the authenticity of paper sheets using only the pixel data for a given position of the bill among the pixel data. The pixel data for a given position may be, for example, data relating a part capable of providing different information depending on the wavelength of irradiation light such as a watermarked part. The part at a given position is not a part at a position associated with a marker as described above.

Then, the processor can divide the bill into small divisions and, when the number of pixels corresponding to a position associated with a marker in a small division has reached a given rate, exclude all pixel data for that small division from the authentication process. The small division can be an area consisting of a given number of pixels. For example, it can be a money class display area. However, the small area does not belong to a so-called characteristic area.

An authenticity judgment method for judging the authenticity of a paper sheet by irradiating the paper sheet with light and analyzing images from the reflected light and transmitted light can be provided, wherein the method comprises the following steps: irradiating the paper sheet with light; acquiring the reflected light along with the positional information of the paper sheet; acquiring the transmitted light along with the positional information of the paper sheet; determining the presence/absence of some state change in a predetermined area based on the reflected light and transmitted light data of the predetermined area at a predetermined position; and excluding the predetermined area from the area for authenticity judgment when the presence of some state change is assumed. The presence of some state change can be assumed when the difference in brightness between the reflected light and transmitted light is equal to or larger than a threshold as a result of comparison with reference data stored in advance.

The predetermined area belongs to a non-characteristic area. Furthermore, a step of determining the money class based on the reflected light or transmitted light data of the predetermined area can be included.

As mentioned above, the embodiment of the present invention is described. However, the present invention is not limited to the above-described embodiments, and various modifications of the present invention can be implemented.

For example, the predetermined area that is excluded from the authenticity judgment when it has some state change can be set up at multiple positions on a bill and its area can be changed as appropriate. In addition, the present invention is characterized in that the authenticity judgment process is executed, when a state change occurs in a predetermined area, by excluding the predetermined area, and the other configuration is not limited to the above-described embodiments, but various modifications may be made to. For example, a configuration, arrangement, etc. of the of the bill reading mean 8 may be appropriately modified.

The present invention can provide a paper sheet processing apparatus capable of improving the accuracy of authenticity judgment even if the paper sheet is wet and has some state change.

The present invention can be applied not only to the bill processing apparatus, but also to a device which provides various kinds of products and services when the paper sheet such as a service ticket and a coupon ticket, for example, is inserted.

What is claimed is:

1. A paper sheet processing apparatus comprising:

a light emitting part which irradiates a paper sheet with light;

a light receiving part which receives transmitted light through the paper sheet and reflected light from the paper sheet, the paper sheet being irradiated by the light emitting part;

a converter which converts the transmitted light and reflected light received by the light receiving part into data including color information having brightness per pixel of a predetermined size as a unit;

a storage part which stores a transmitted light image constituted of a plurality of pixels converted by the converter from the transmitted light received by the light receiving part, a reflected light image constituted of a plurality of pixels converted by the converter from the reflected light received by the light receiving part, and a reference data for authenticity judgment;

a determining part which determines whether a predetermined area has a state change based on a comparison result between brightness of pixels in the predetermined area of the transmitted image and brightness of pixels of the reflected image corresponding to the predetermined area of the transmitted image; and a comparison judgment part which compares an image data of the paper sheet with the reference data in order to judge authenticity of the paper sheet, wherein when the predetermined area has no state change, an image data of the predetermined area is included in the image data of the paper sheet and when the predetermined area has the state change, the image data of the predetermined area is excluded from the image data of the paper sheet.

2. The paper sheet processing apparatus according to claim 1, wherein the predetermined area is arranged in an area other than a characteristic area from which different pixel information is acquired when the light emitting part irradiates the characteristic area with light of a different wavelength.

3. The paper sheet processing apparatus according to claim 2, wherein the light receiving part comprises a line sensor which reads an entire range in a width direction of the paper sheet.

4. The paper sheet processing apparatus according to claim 1, wherein the light receiving part comprises a line sensor which reads an entire range in a width direction of the paper sheet.

5. A paper sheet processing apparatus comprising:

a light emitting part which irradiates a paper sheet with light;

a light receiving part which receives transmitted light through the paper sheet and reflected light from the paper sheet, the paper sheet being irradiated by the light emitting part;

a processor which is capable of controlling the light emitting part and the light receiving part; and a storage part which is connected to the processor, wherein the processor is operative to:

digitize the transmitted light and the reflected light which are received by the light receiving part based on respective brightness per each pixel of a predetermined size as a unit as color information having the respective brightness is included, and allow the storage part to store such digitized data in association with a location of each pixel in the images;

determine whether the reflected light and the transmitted light at each pixel location are in a predetermined relationship;

when the reflected light and the transmitted light at a pixel location are in a predetermined relationship, control the storage part to store a marker to indicate not to use pixel data at the pixel location;

judge an authenticity of the paper sheet based on each pixel data stored by the storage part, excluding the pixel data at the pixel location with which the marker is associated.

6. The paper sheet processing apparatus according to claim 5, wherein the processor is operative to judge the authenticity of the paper sheet by using only data located at predetermined positions of the paper sheet among the pixel data.

7. The paper sheet processing apparatus according to claim 5, wherein the processor is operative to divide the paper sheet into a plurality of unit areas and, when a number of pixels to which the marker is attached in each unit area reaches a predetermined fraction of entirety, to determine to use none of the pixel data in the unit area for the authenticity judgment process.

8. A method of judging an authenticity by analyzing images by reflected light and transmitted light from a paper sheet to which light is irradiated, comprising the steps of:

irradiating the paper sheet with a light emitter;

acquiring transmitted light with location information thereof in the paper sheet with a light receiver;

acquiring reflected light with location information thereof in the paper sheet with the light receiver;

judging whether a state change occurs in a predetermined area based on the transmitted light and the reflected light of the predetermined area having been located at a predetermined position with a controller; and excluding the predetermined area for the authenticity judgment when the state change is occurred and including the predetermined area for the authenticity judgment when the state change is not occurred, with the controller.

9. The method of judging the authenticity according to claim 8, wherein the predetermined area is a non-characteristic area.

10. The method of judging the authenticity according to claim 9, comprising the step of determining a face value based on data by the reflected light and transmitted light from the predetermined area.

11. The method of judging the authenticity according to claim 8, comprising the step of determining a face value based on data by the reflected light and transmitted light from the predetermined area.

* * * * *